US010719033B2

(12) United States Patent
Kimura et al.

(10) Patent No.: US 10,719,033 B2
(45) Date of Patent: Jul. 21, 2020

(54) TONER CARTRIDGE AND TONER SUPPLYING MECHANISM

(71) Applicant: CANON KABUSHIKI KAISHA, Tokyo (JP)

(72) Inventors: Takashi Kimura, Tokyo (JP); Hisayoshi Kojima, Mishima (JP); Yosuke Kashiide, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/366,023

(22) Filed: Mar. 27, 2019

(65) Prior Publication Data

US 2019/0219948 A1 Jul. 18, 2019

Related U.S. Application Data

(63) Continuation of application No. PCT/JP2017/036050, filed on Sep. 27, 2017.

(30) Foreign Application Priority Data

Sep. 30, 2016 (JP) ..... 2016-192719

(51) Int. Cl.
*G03G 15/08* (2006.01)
*G03G 21/16* (2006.01)

(52) U.S. Cl.
CPC ..... *G03G 15/0886* (2013.01); *G03G 15/08* (2013.01); *G03G 15/0872* (2013.01); (Continued)

(58) Field of Classification Search
CPC ..... G03G 15/0886; G03G 15/0872; G03G 15/08; G03G 21/16; G03G 2215/067; G03G 2221/1657
See application file for complete search history.

(56) References Cited

U.S. PATENT DOCUMENTS 5,235,383 A 8/1993 Tada et al.
5,249,026 A 9/1993 Kojima
(Continued)

FOREIGN PATENT DOCUMENTS

EP 1 684 130 A 7/2006
EP 1 975 734 A 10/2008
(Continued)

OTHER PUBLICATIONS

Co-pending U.S. Appl. No. 16/362,859, filed Mar. 25, 2019.
(Continued)

*Primary Examiner* — Hoang X Ngo
(74) *Attorney, Agent, or Firm* — Venable LLP

(57) ABSTRACT

To develop a conventional structure of a toner cartridge. Toner cartridge includes a container and an open/close member. The container includes an accommodating portion, a discharge opening and a cartridge side guide. the open/close member includes a closing portion and an engaging portion and is movable between a closing position and an opening position. When the toner cartridge is dismounted from a receiving apparatus, the engaging portion receives a force for moving the open/close member from the opening position toward the closing position, the engaging with a receiving apparatus side guide of the receiving apparatus.

20 Claims, 19 Drawing Sheets

(52) U.S. Cl.
CPC ..... *G03G 21/16* (2013.01); *G03G 2215/067* (2013.01); *G03G 2221/1657* (2013.01)

(56) References Cited

U.S. PATENT DOCUMENTS

| | | | | |
|---|---|---|---|---|
| 5,414,493 | A | 5/1995 | Fujii et al. | |
| 5,442,421 | A | 8/1995 | Kojima | |
| 5,471,284 | A | 11/1995 | Fujii et al. | |
| 5,497,220 | A | 3/1996 | Inomata et al. | |
| 5,521,693 | A | 5/1996 | Kojima et al. | |
| 5,528,343 | A | 6/1996 | Tada et al. | |
| 5,579,101 | A | 11/1996 | Omata et al. | |
| 5,940,657 | A | 8/1999 | Yokomori et al. | |
| 5,950,049 | A | 9/1999 | Yokomori et al. | |
| 5,963,759 | A | 10/1999 | Kojima et al. | |
| 5,991,571 | A | 11/1999 | Yamada et al. | |
| 6,072,969 | A | 6/2000 | Yokomori et al. | |
| 6,131,011 | A | 10/2000 | Kojima et al. | |
| 6,157,792 | A | 12/2000 | Mori et al. | |
| 6,178,301 | B1 | 1/2001 | Kojima et al. | |
| 6,185,401 | B1 * | 2/2001 | Kanamori | G03G 15/0872 399/119 |
| 6,266,503 | B1 | 7/2001 | Murayama et al. | |
| 6,289,189 | B1 | 9/2001 | Numagami et al. | |
| 6,314,266 | B1 | 11/2001 | Murayama et al. | |
| 6,345,164 | B1 | 2/2002 | Yokomori et al. | |
| 6,400,916 | B1 | 6/2002 | Go et al. | |
| 6,404,996 | B1 | 6/2002 | Mori et al. | |
| 6,442,359 | B1 | 8/2002 | Numagami et al. | |
| 6,453,135 | B1 | 9/2002 | Sameshima et al. | |
| 6,463,233 | B2 | 10/2002 | Kojima et al. | |
| 6,564,029 | B2 | 5/2003 | Kojima et al. | |
| 6,577,831 | B1 | 6/2003 | Kojima et al. | |
| 6,608,980 | B2 | 8/2003 | Murayama et al. | |
| 7,738,818 | B2 * | 6/2010 | Murakami | G03G 15/0872 399/258 |
| 7,899,361 | B2 | 3/2011 | Kwon | 399/117 |
| 8,583,001 | B2 | 11/2013 | Kubo et al. | |
| 9,052,640 | B2 | 6/2015 | Kashiide et al. | |
| 9,213,306 | B2 | 12/2015 | Morioka et al. | |
| 9,256,161 | B2 | 2/2016 | Hayashi et al. | |
| 9,377,714 | B2 | 6/2016 | Nakazawa et al. | |
| 9,429,906 | B2 | 8/2016 | Yoshimura et al. | |
| 9,465,318 | B2 | 10/2016 | Takeuchi et al. | |
| 9,523,942 | B2 | 12/2016 | Takeuchi et al. | |
| 9,541,863 | B2 | 1/2017 | Kashiide et al. | |
| 9,632,451 | B2 | 4/2017 | Hayashi et al. | |
| 9,836,020 | B2 | 12/2017 | Yoshimura et al. | |
| 9,989,892 | B2 | 6/2018 | Takeuchi et al. | |
| 10,168,664 | B2 | 1/2019 | Yoshimura et al. | |
| 2004/0052559 | A1 | 3/2004 | Jeong et al. | |
| 2008/0226341 | A1 | 9/2008 | Mase et al. | |
| 2009/0129813 | A1 | 5/2009 | Nagashima et al. | |
| 2010/0278564 | A1 | 11/2010 | Nagashima et al. | |
| 2017/0139372 | A1 | 5/2017 | Kashiide et al. | |
| 2017/0261926 | A1 | 9/2017 | Kashiide et al. | |
| 2019/0171154 | A1 | 6/2019 | Yoshimura et al. | |
| 2019/0179258 | A1 | 6/2019 | Kashiide et al. | |
| 2019/0268049 | A1 | 9/2019 | Kashiide et al. | |
| 2019/0286049 | A1 | 9/2019 | Kashiide et al. | G03G 21/1647 |

FOREIGN PATENT DOCUMENTS

| | | | |
|---|---|---|---|
| JP | H07-199623 | A | 8/1995 |
| JP | 2008-224962 | A | 9/2008 |
| JP | 2009-175759 | A | 8/2009 |
| JP | 2016-157099 | | 9/2016 |
| JP | 2016-157099 | A | 9/2016 |
| JP | 2017-182006 | A | 10/2017 |
| KR | 10-2008-0087559 | | 10/2008 |

OTHER PUBLICATIONS

Examination Report in Australian Patent Application No. 2017337463, dated Aug. 29, 2019.

International Search Report and Written Opinion for International Patent Application No. PCT/JP2017/036050, dated Dec. 26, 2017.

Nov. 19, 2018 Office Action in Taiwanese Patent Application No. 106133620.

English translation of Japanese Patent Application Pub. No. 2017-182006 A.

Examination Report in Canadian Patent Application No. 3,038,787, dated Jan. 14, 2020.

Office Action in Russian Patent Application No. 2019112737, dated Oct. 29, 2019.

Machine translation of Japanese Patent Application No. 2008-224962 (application published Sep. 25, 2008).

Office Action dated Apr. 14, 2020 in counterpart Korean Application No. 10-2019-7012319, together with English translation thereof.

May 18, 2020 Extended Search Report in European Patent Application No. 17856518.0.

* cited by examiner (a)

(b)

TONER CARTRIDGE AND TONER SUPPLYING MECHANISM

TECHNICAL FIELD

The present invention relates to a toner cartridge and a toner supplying mechanism to be used for forming an electrophotographic image.

BACKGROUND ART

In an electrophotographic image forming apparatus, there has been known a structure in which elements such as a photosensitive drum and a developing roller as a rotatable member to be used for image formation are integrated into a cartridge mountable to and dismountable from an image forming apparatus main assembly (hereinafter, main assembly of the image forming apparatus).

In a structure in which a cartridge is dismountably mounted in an image forming apparatus, there is also known a structure in which a toner cartridge containing toner (developer) to be consumed with the image formation can be replaced separately from the photosensitive drum and developing roller.

With such a structure, the toner (developer) contained in the toner cartridge is supplied into a developing device including a developing roller and the like through a discharge port. In addition, in order to prevent the toner from leaking to the outside from the discharge port, an opening and closing member such as a shutter for opening and closing the discharge opening is provided.

For example, Japanese Laid-open Patent Application No. H07-199623 discloses a structure in which a shutter is opened by rotating a toner cartridge when a cylindrical toner cartridge (developer supply container) is mounted in the image forming apparatus main assembly.

SUMMARY OF THE INVENTION

Problems to be Solved by Invention

The object of the present invention is to develop the aforementioned prior art.

Means to Solve the Problem

A representative structure according to the present application is a toner cartridge detachably mountable to a receiving apparatus, the receiving apparatus including a toner receiving opening and a receiving apparatus side guide, said toner cartridge comprising a container including an accommodating portion for accommodating toner, a discharge opening for discharging the toner from said accommodating portion toward said receiving opening, and a cartridge side guide configured to be guided by the receiving apparatus side guide; and an open/close member including a closing portion for closing said discharge opening, an engaging portion engageable with the receiving apparatus side guide, wherein said open/close member being movable relative to said container between a closing position for causing said closing portion to close said discharge opening and an opening position for causing said closing portion to open said discharge opening, wherein when said toner cartridge is dismounted from said receiving apparatus, said engaging portion receives, by engagement with the receiving apparatus side guide, a force for moving said open/close member from the opening position to the closing position.

Effect of the Invention

The above-mentioned conventional technique can be developed.

BRIEF DESCRIPTION OF THE DRAWINGS

Parts (a) and (b) of FIG. 1 are side views of a toner cartridge according to an embodiment.

Figure 4:
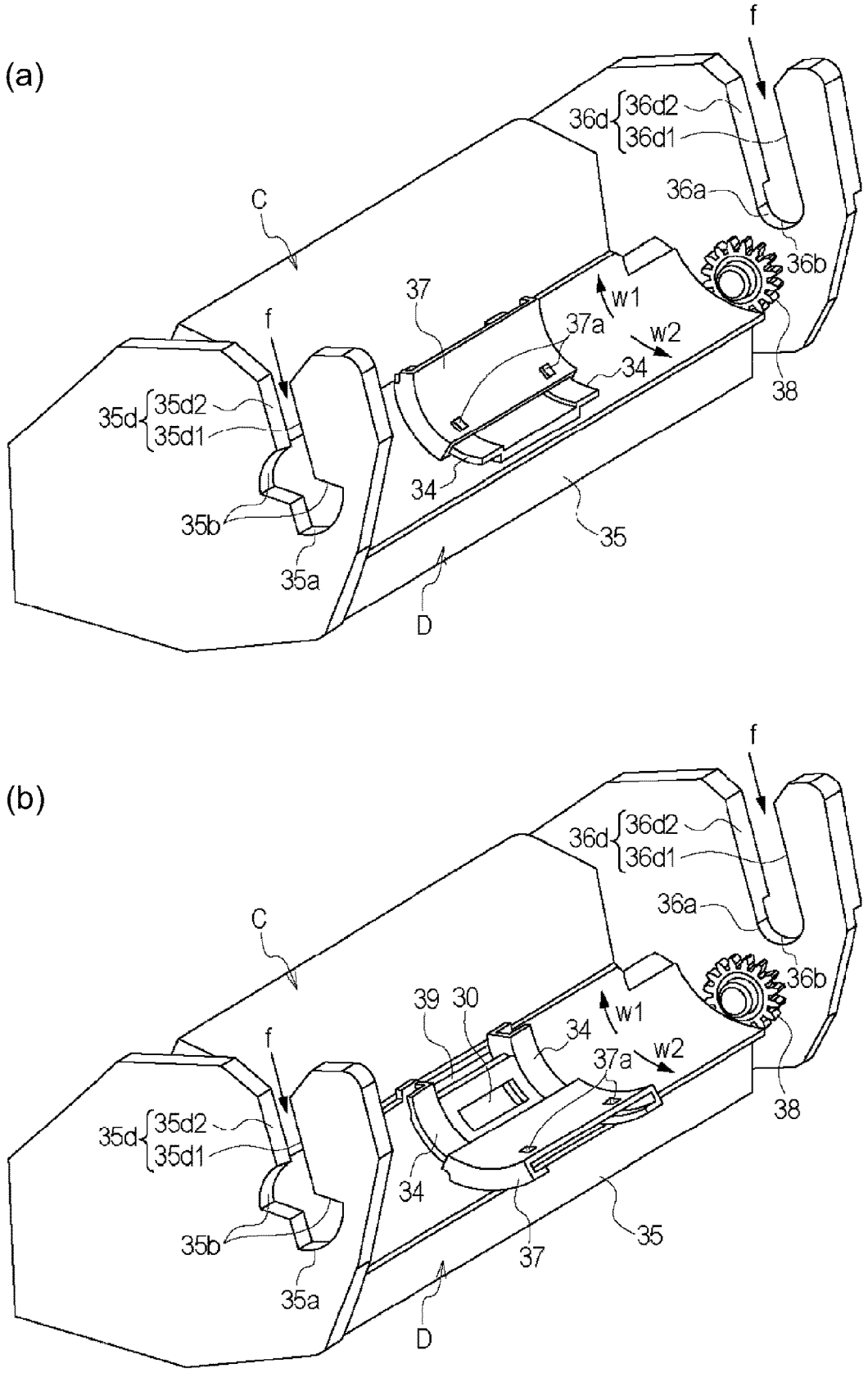

Parts (a) and (b) of FIG. 4 are schematic perspective views of the developing unit according to the embodiment.

Figure 5:
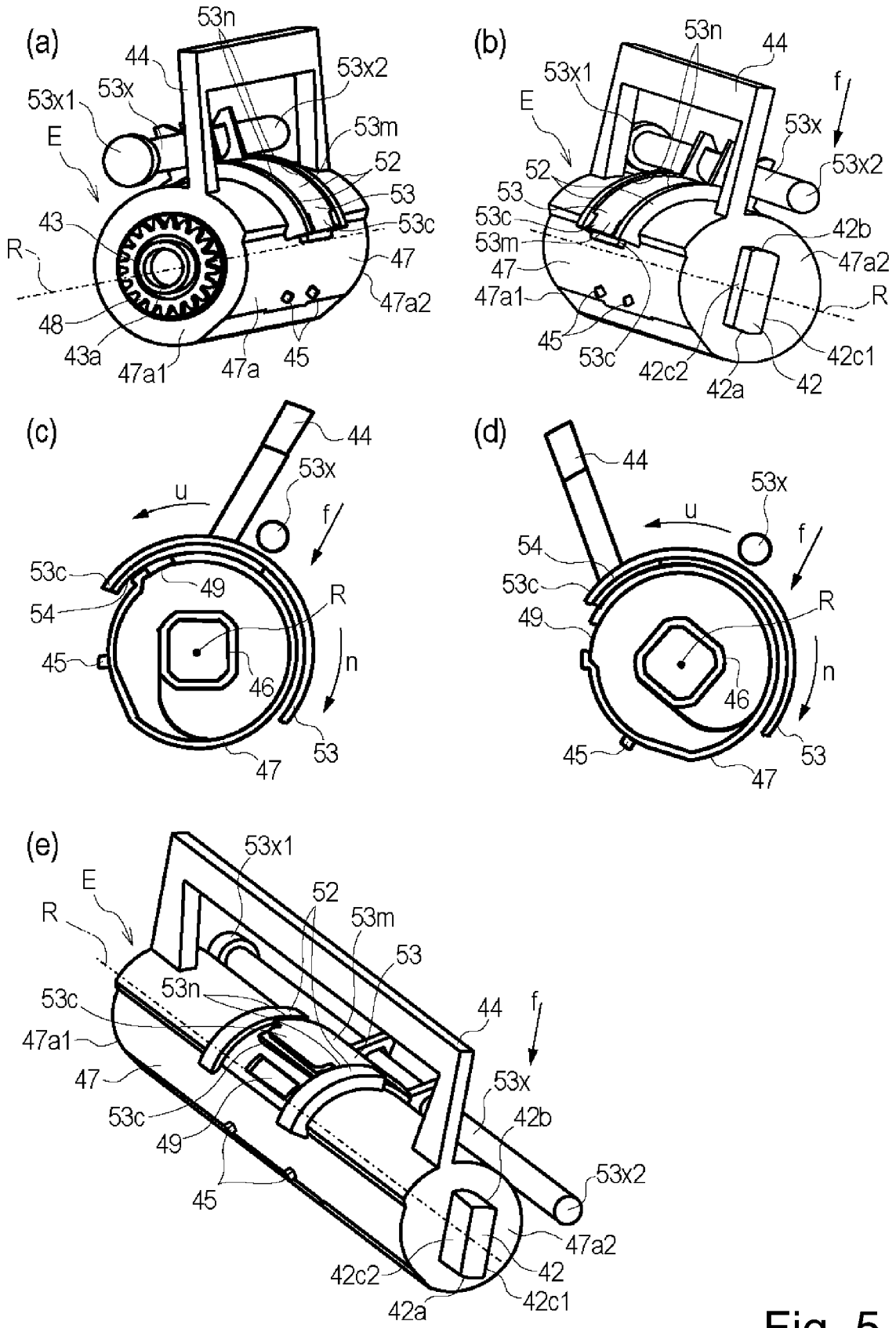

Parts (a), (b), (c), (d) and (e) of FIG. 5 are schematic views of the toner cartridge according to the embodiment.

Figure 6:
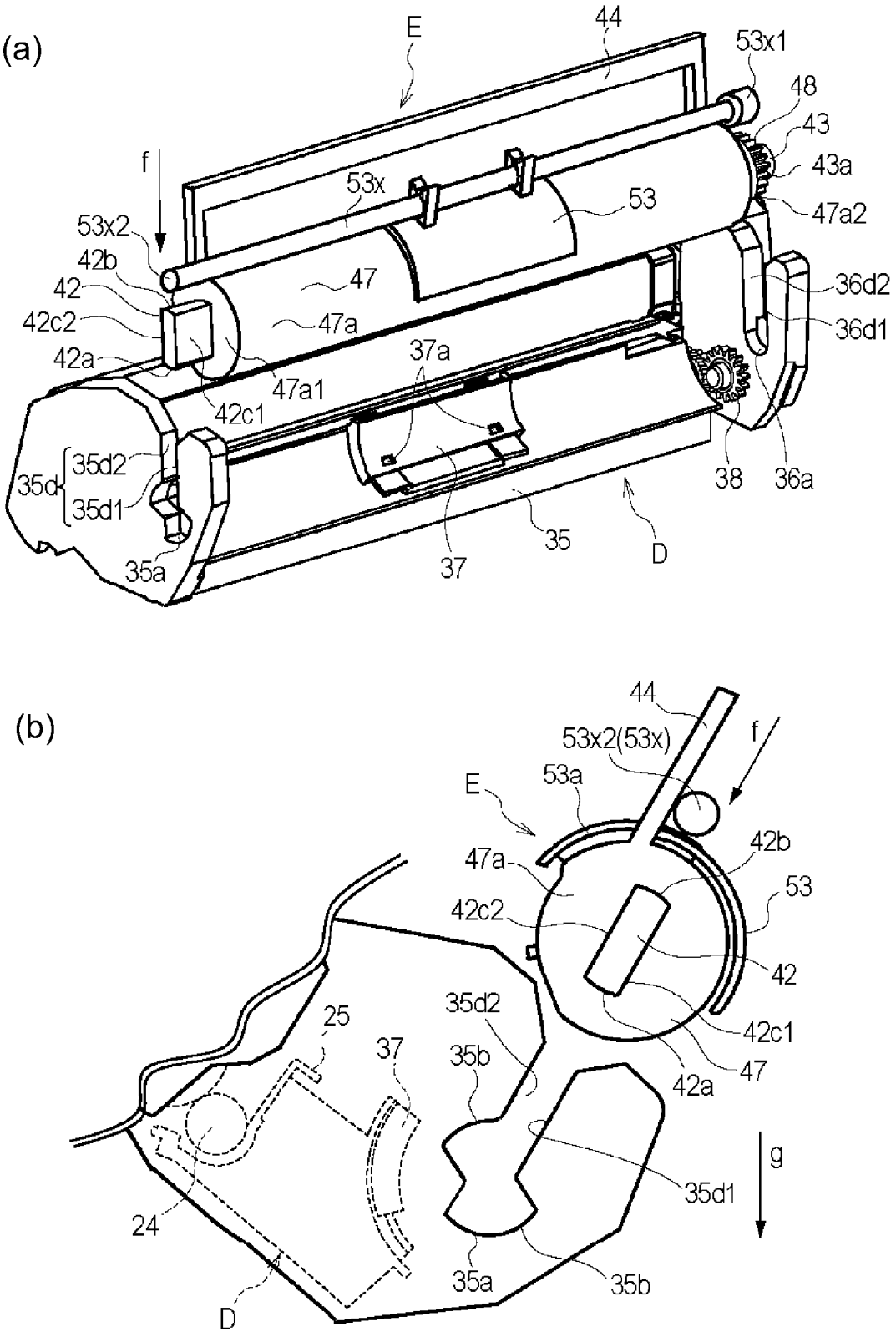

Parts (a) and (b) of FIG. 6 are schematic illustrations of a developing unit and a toner cartridge before mounting (insertion).

Figure 7:
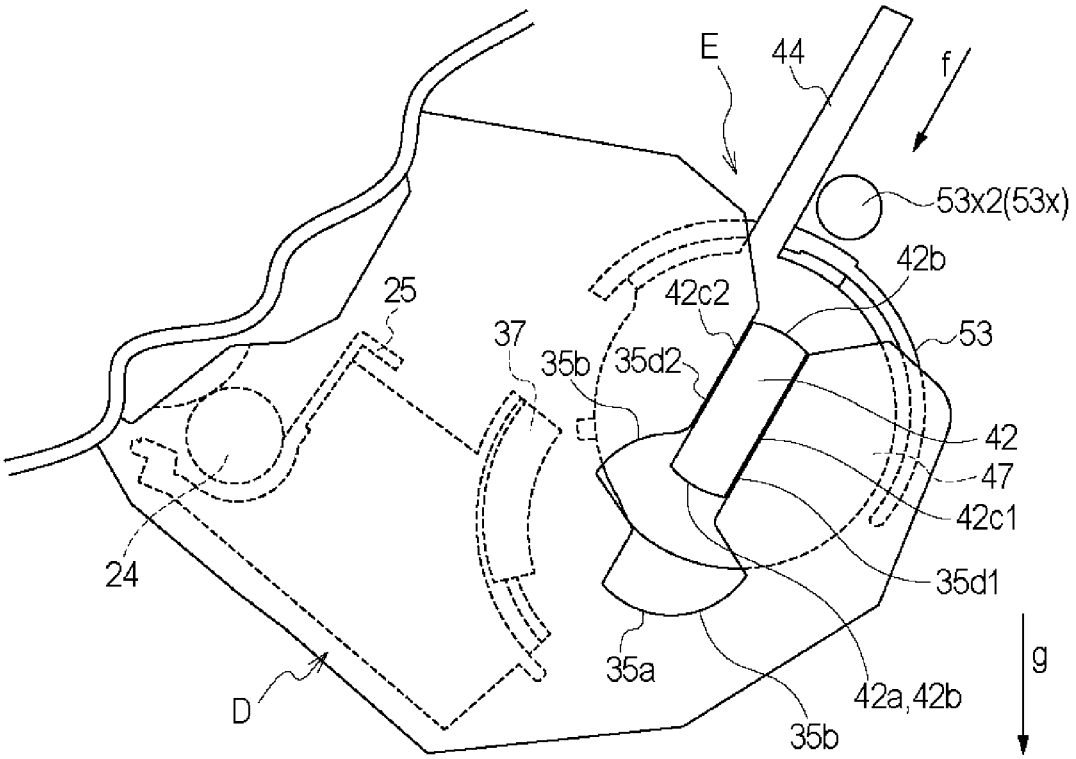

FIG. 7 is a schematic illustration of the developing unit and the toner cartridge during mounting (insertion).

Figure 8:
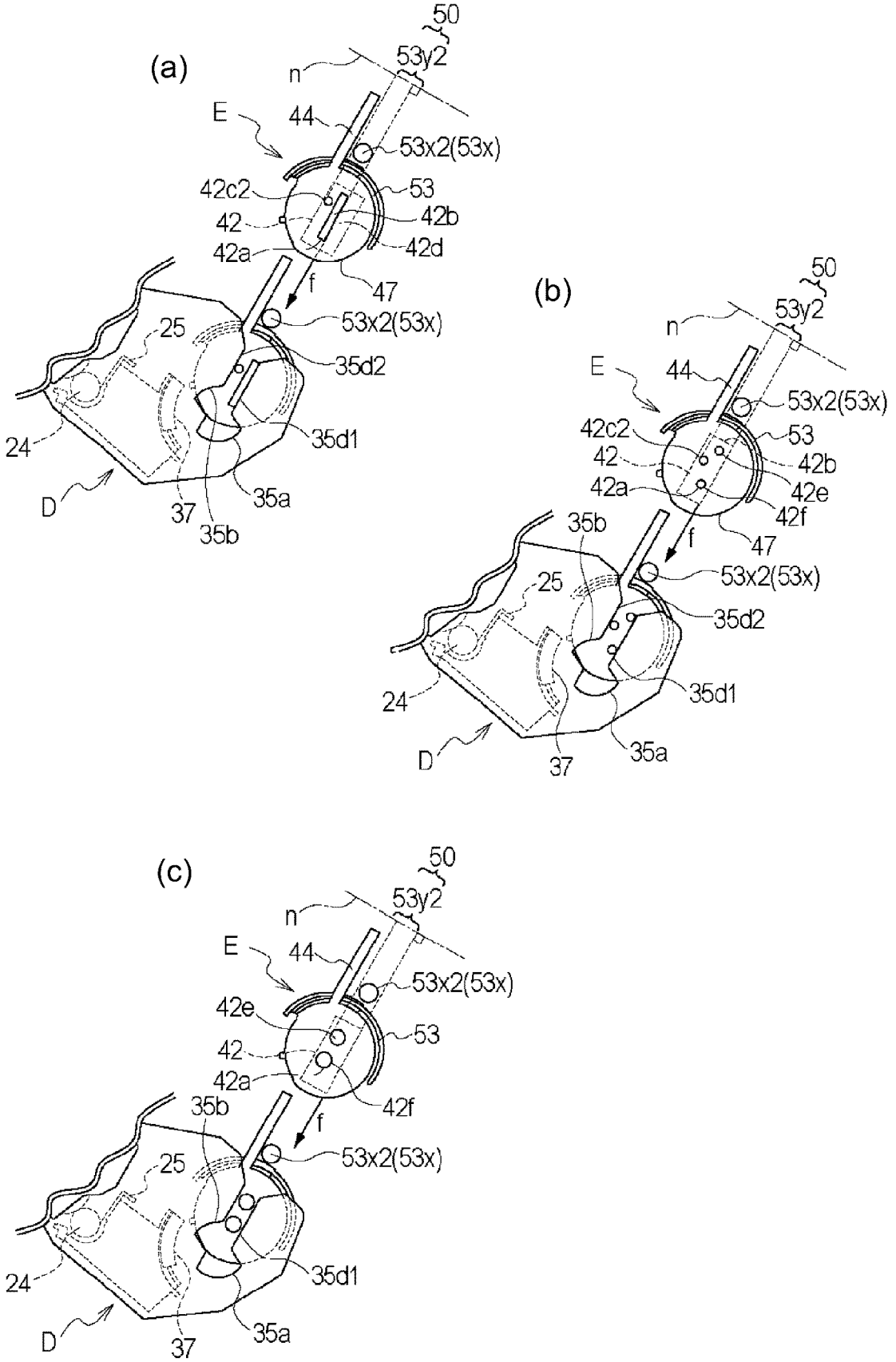

Parts (a), (b) and (c) of FIG. 8 are schematic side views illustrating a modified example of the structure of an insertion guided portion (portion to be guided in insertion).

Figure 9:
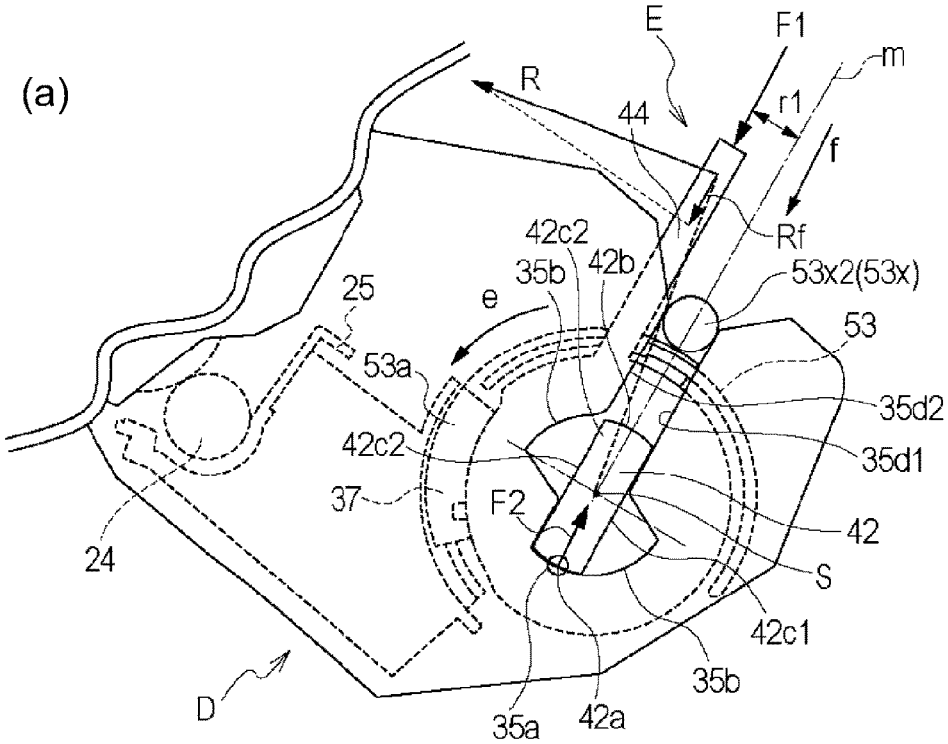
Figure 9:
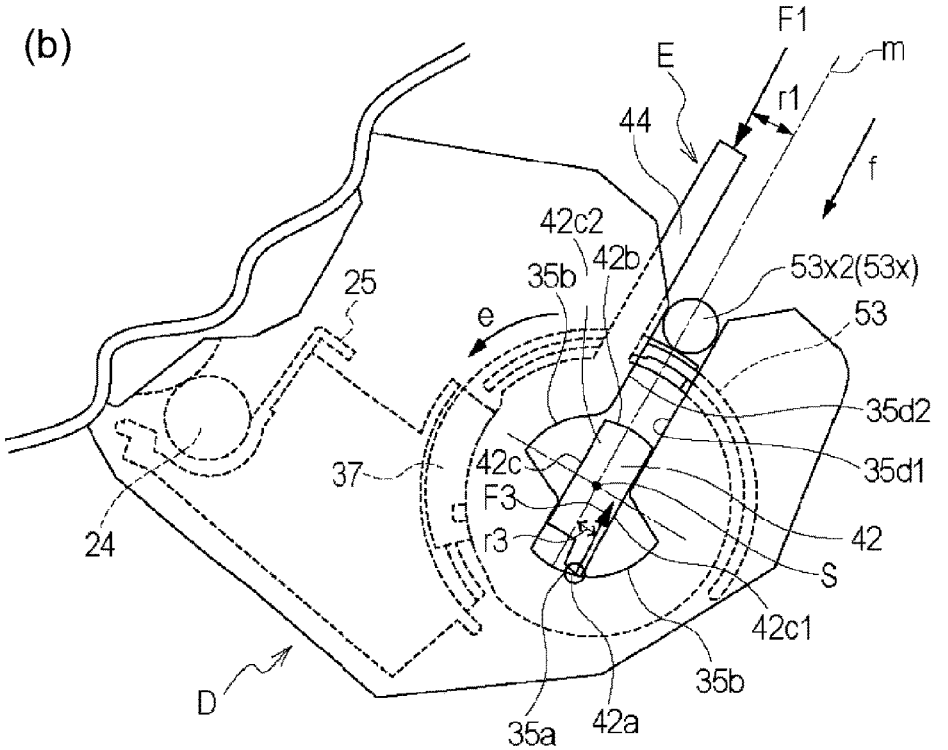

Parts (a) and (b) of FIG. 9 are schematic side views illustrating a force relationship acting on the toner cartridge.

Figure 10:
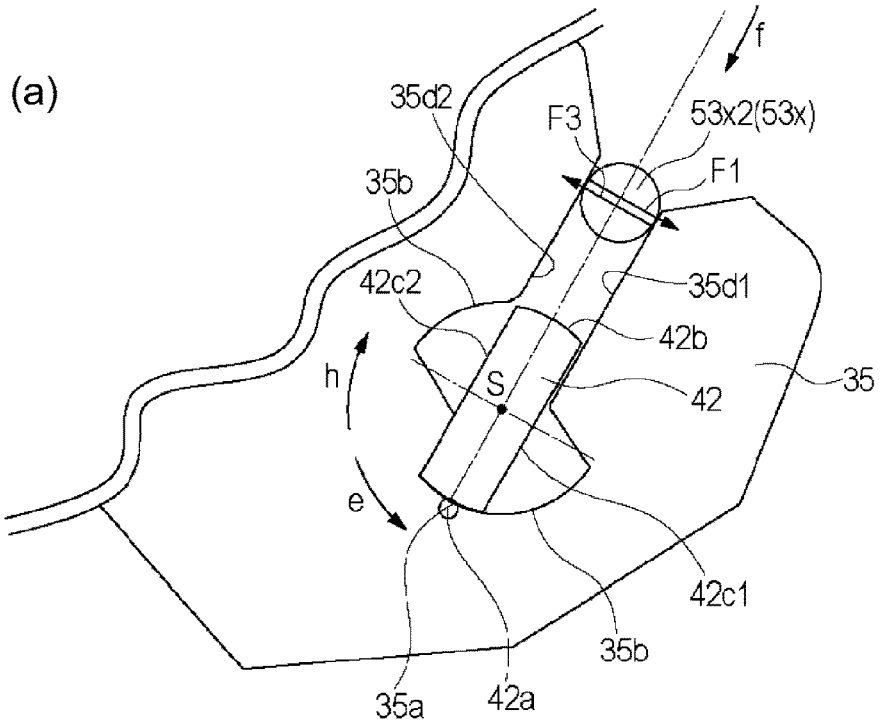
Figure 10:
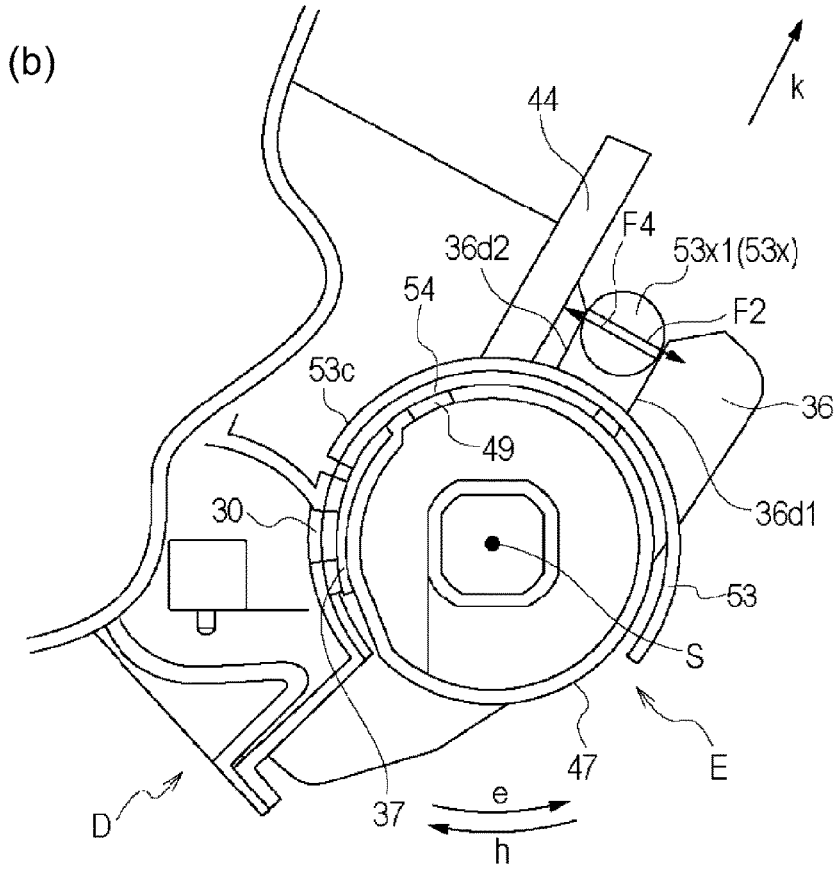

Parts (a) and (b) of FIG. 10 are schematic illustrations showing a state in which the abutting portion and the abutted portion are abutted against each other.

Figure 11:
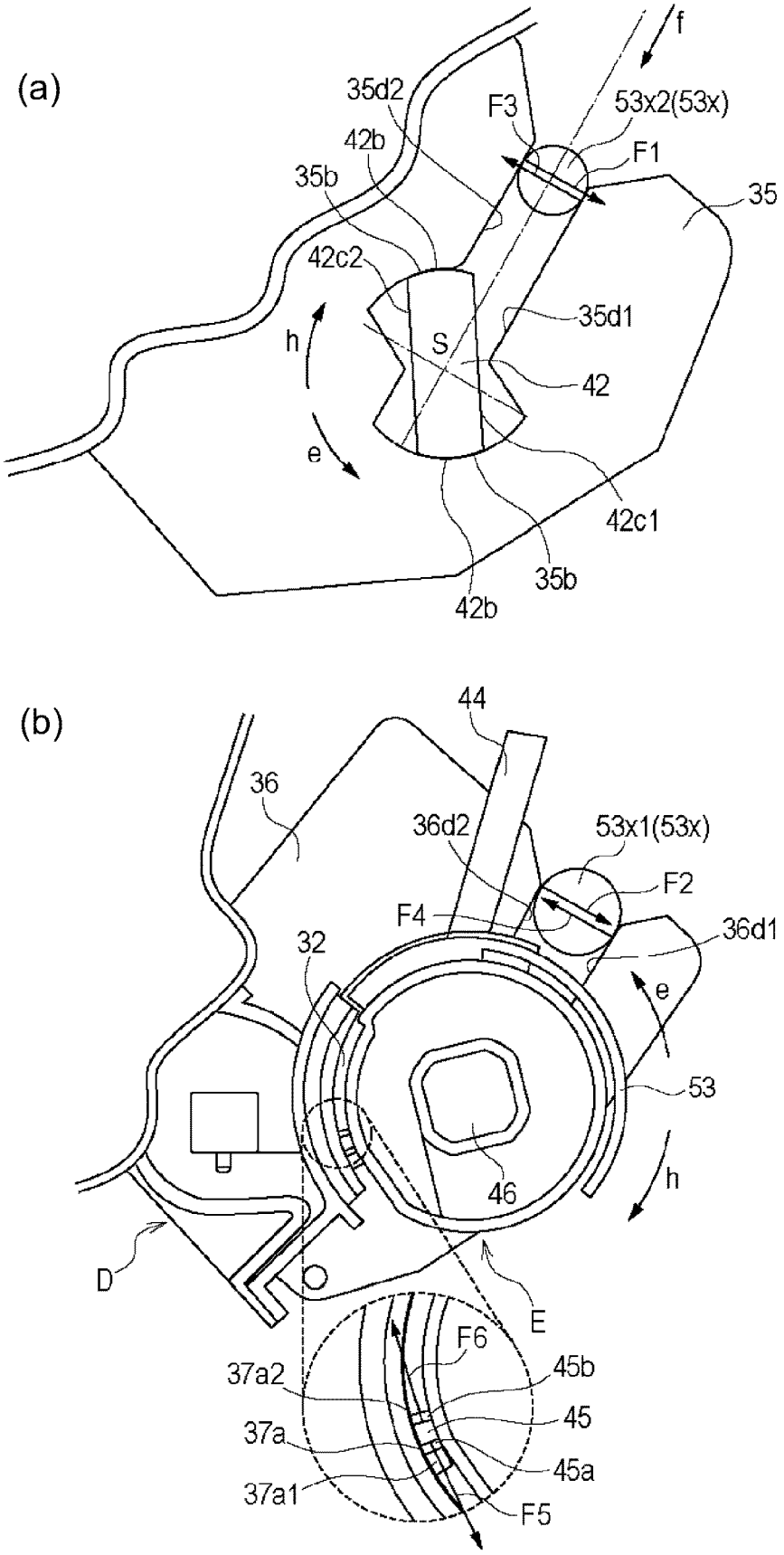

Parts (a) and (b) of FIG. 11 are schematic illustrations when the container frame is rotated so that the toner cartridge is positioned in place.

Figure 12:
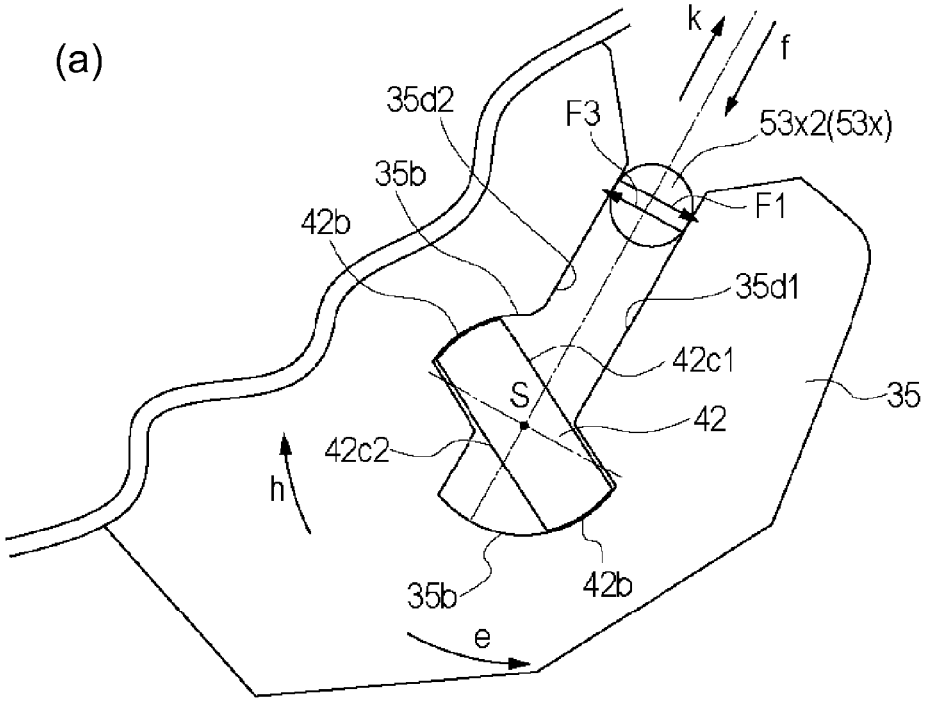
Figure 12:
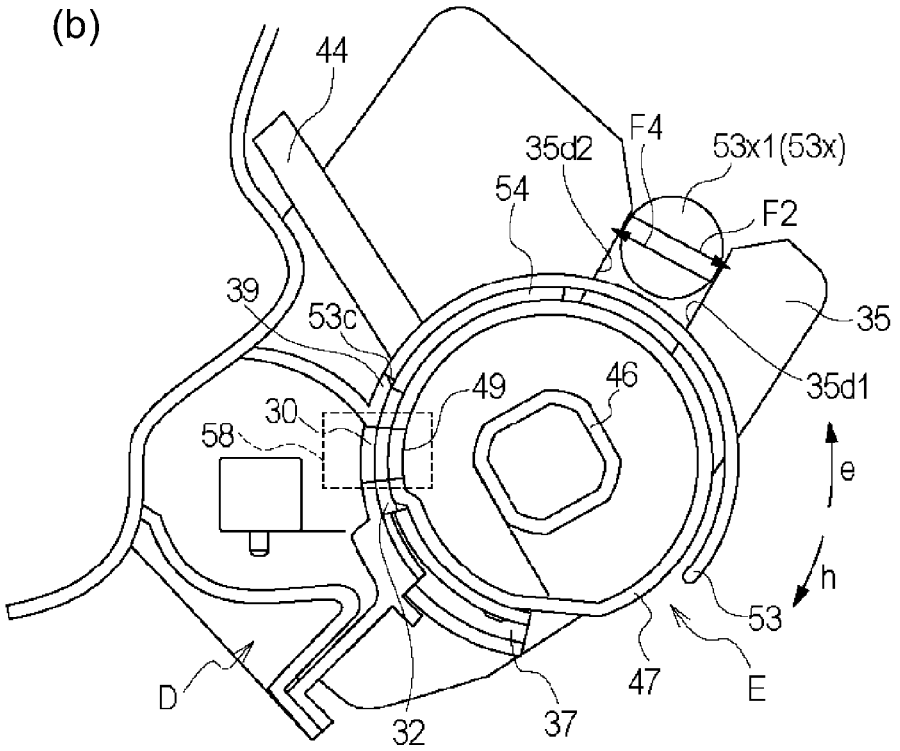

Parts (a) and (b) of FIG. 12 are schematic illustrations when each shutter moves to an open position and each toner storing portion is communicated.

Figure 13:
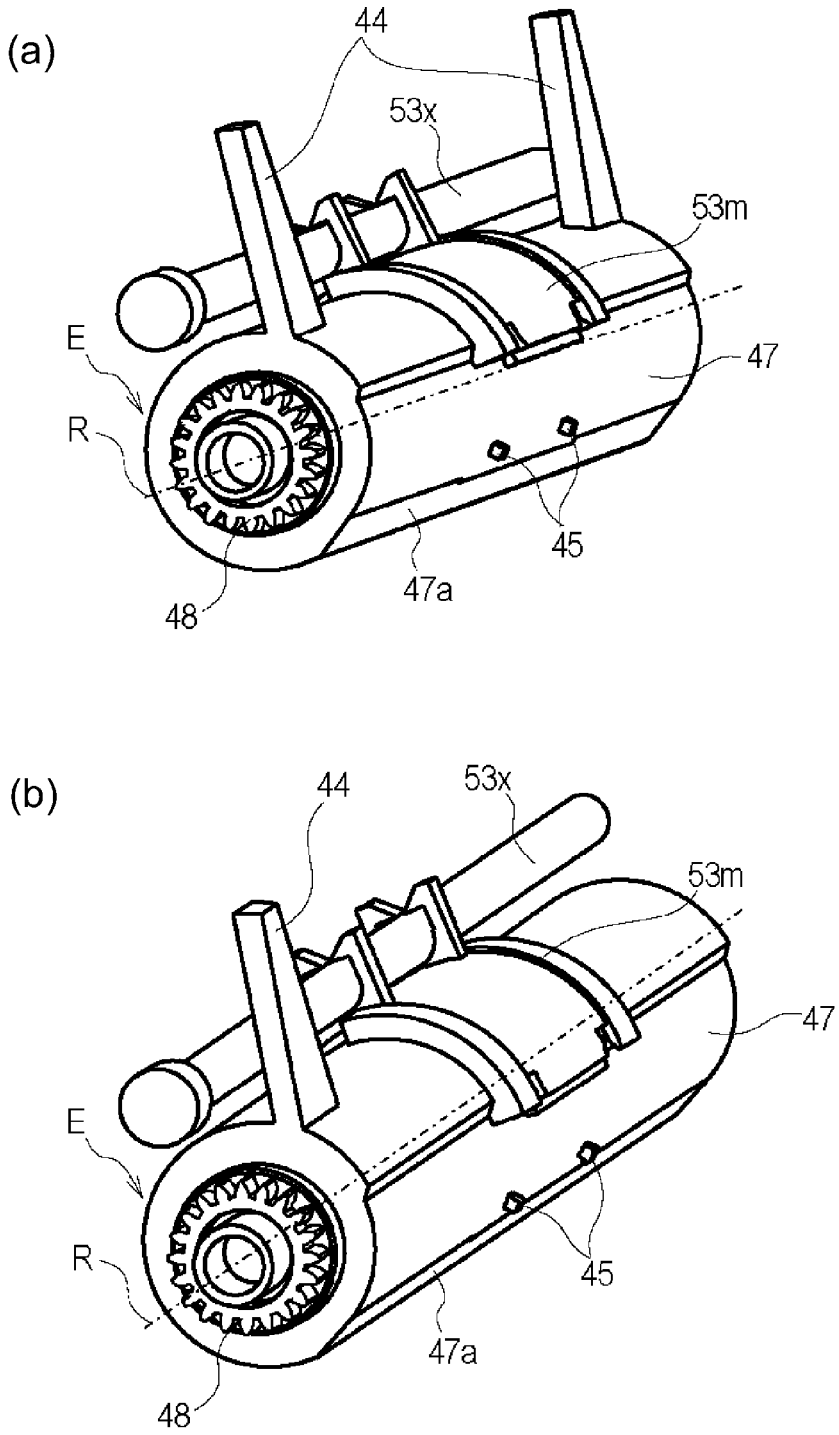

Parts (a) and (b) of FIG. 13 are perspective views illustrating a modified example of the structure of an operating portion of the toner cartridge.

Figure 14:
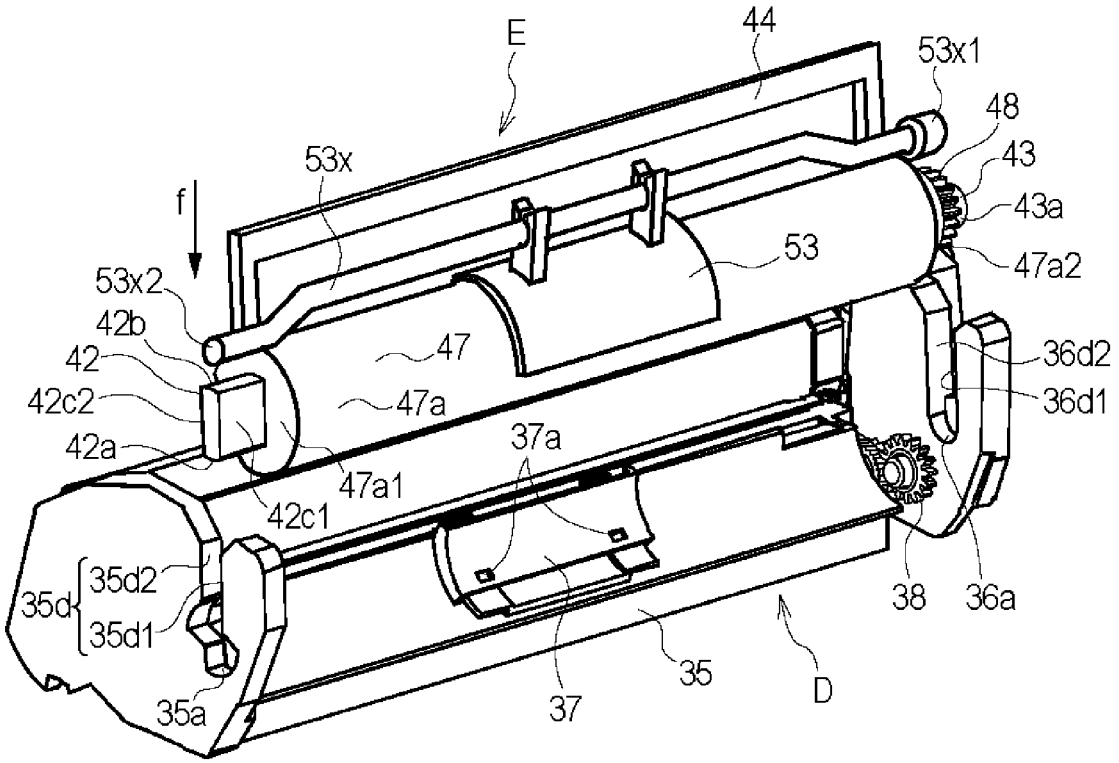

FIG. 14 is a perspective view of the developing unit and the toner cartridge showing a modified example of the structure of an extending member.

Figure 15:
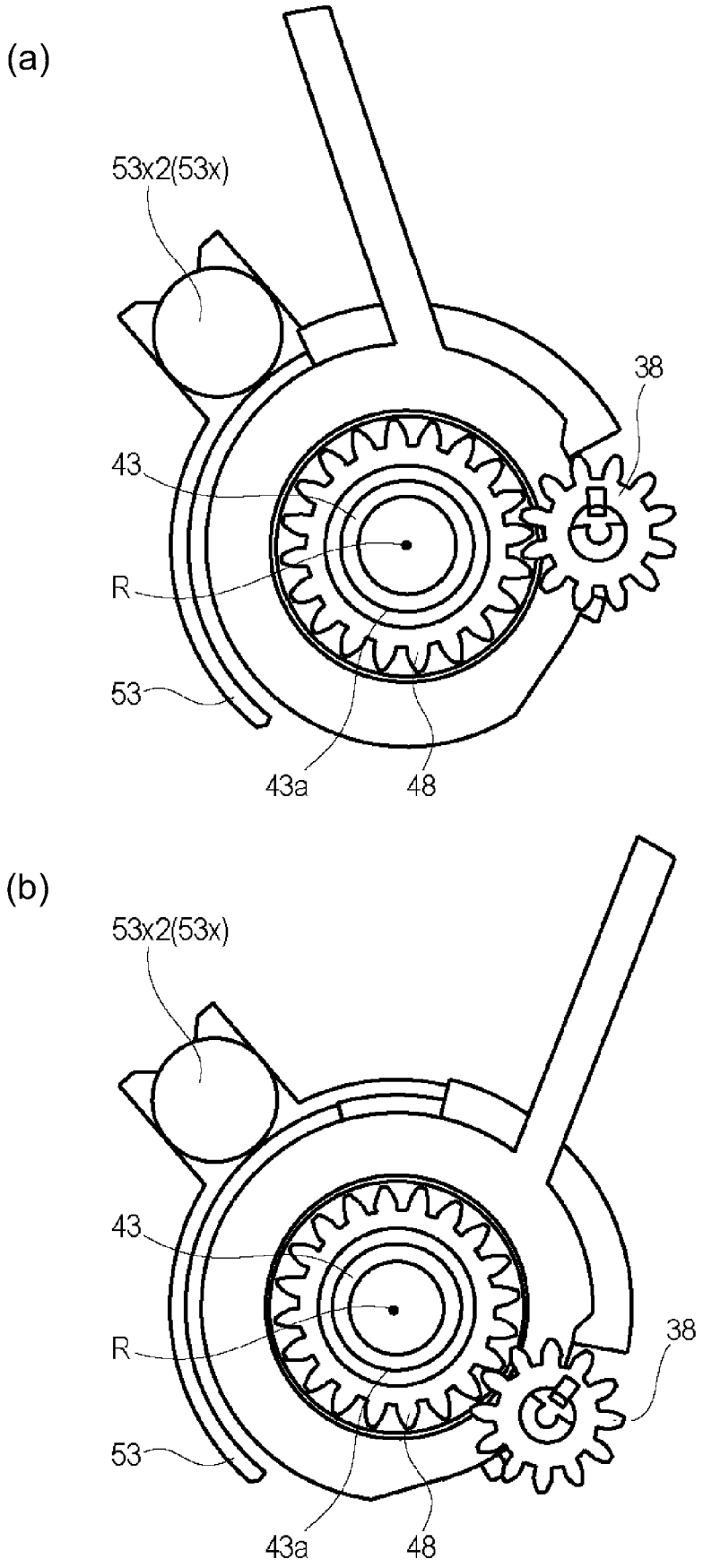

Parts (a) and (b) of FIG. 15 are side views in a case where a drive transmission portion engaging with a second drive transmission portion is provided in the toner cartridge.

Figure 16:
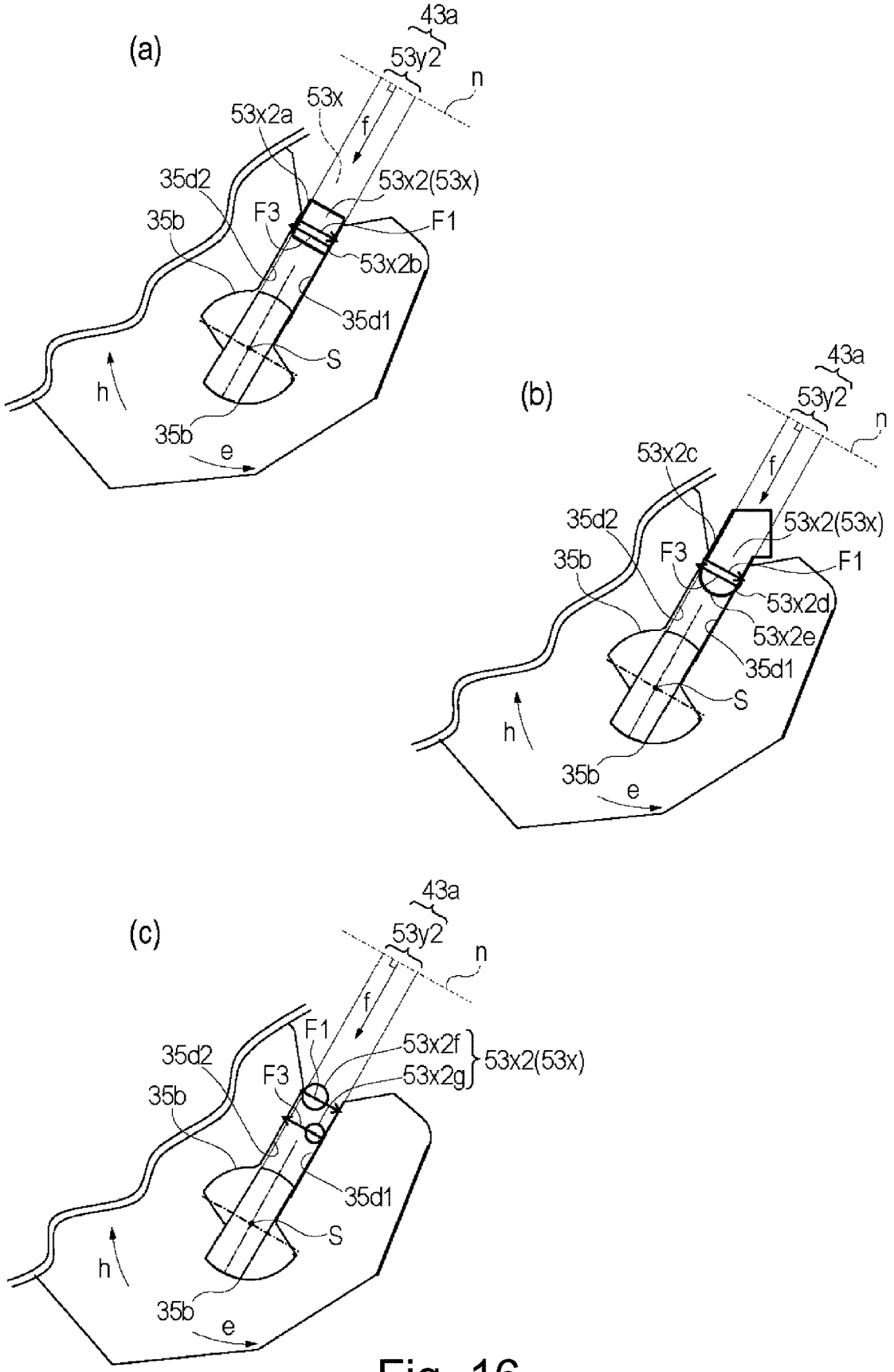

Parts (a), (b) and (c) of FIG. 16 are side cross-sectional views of the developing unit and the toner cartridge showing a modified example of the structure of a restricting portion.

Figure 17:
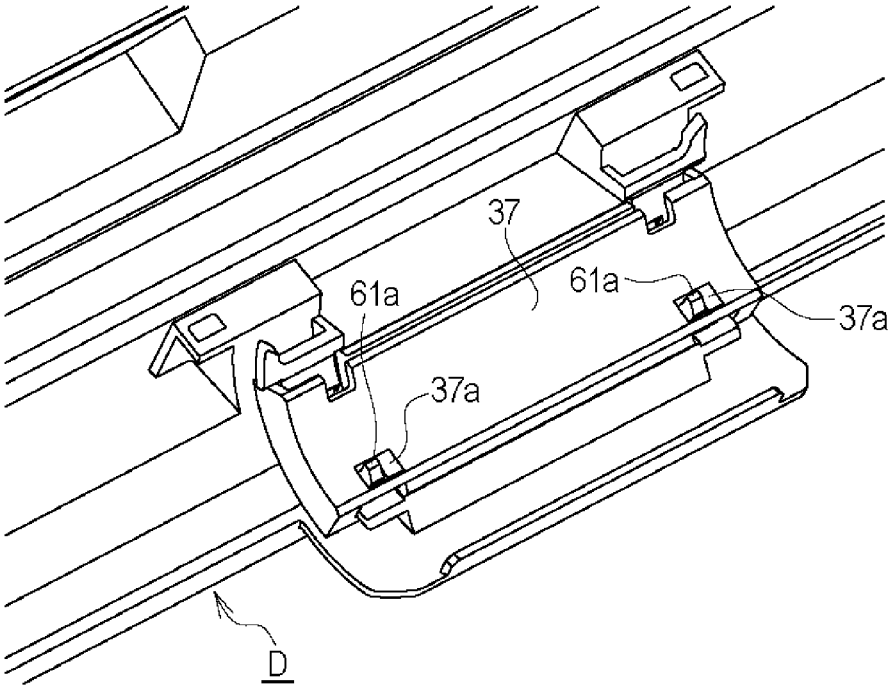
Figure 17:
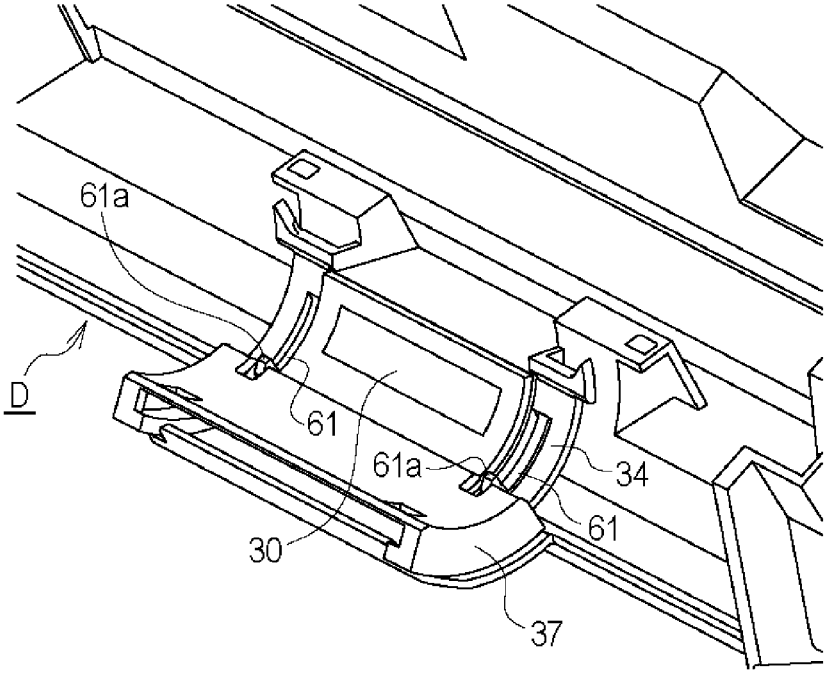

Parts (a) and (b) of FIG. 17 are perspective views of the developing unit.

Figure 18:
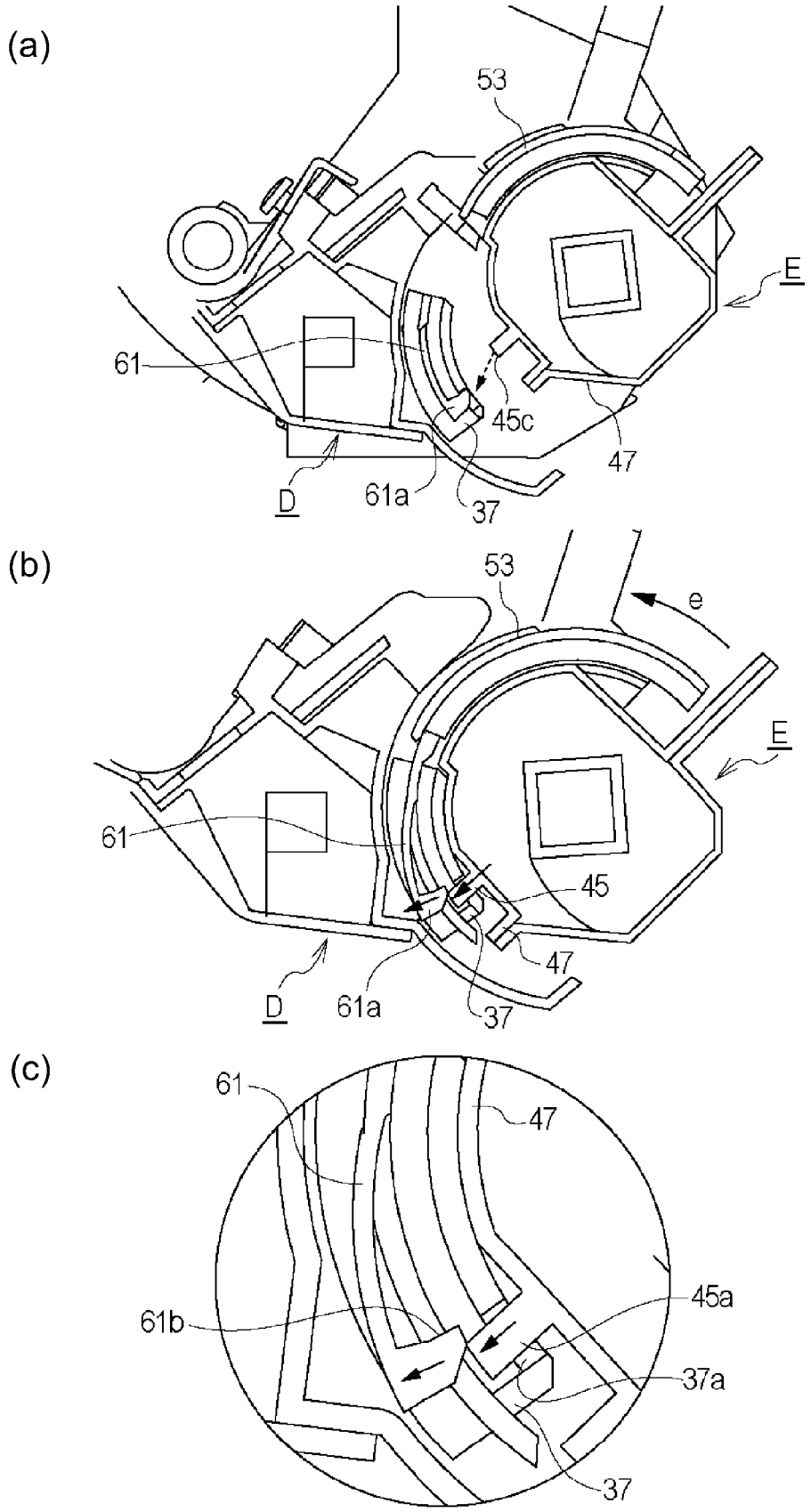

Parts (a), (b) and (c) of FIG. 18 are sectional views of the developing unit and the toner cartridge.

Figure 19:
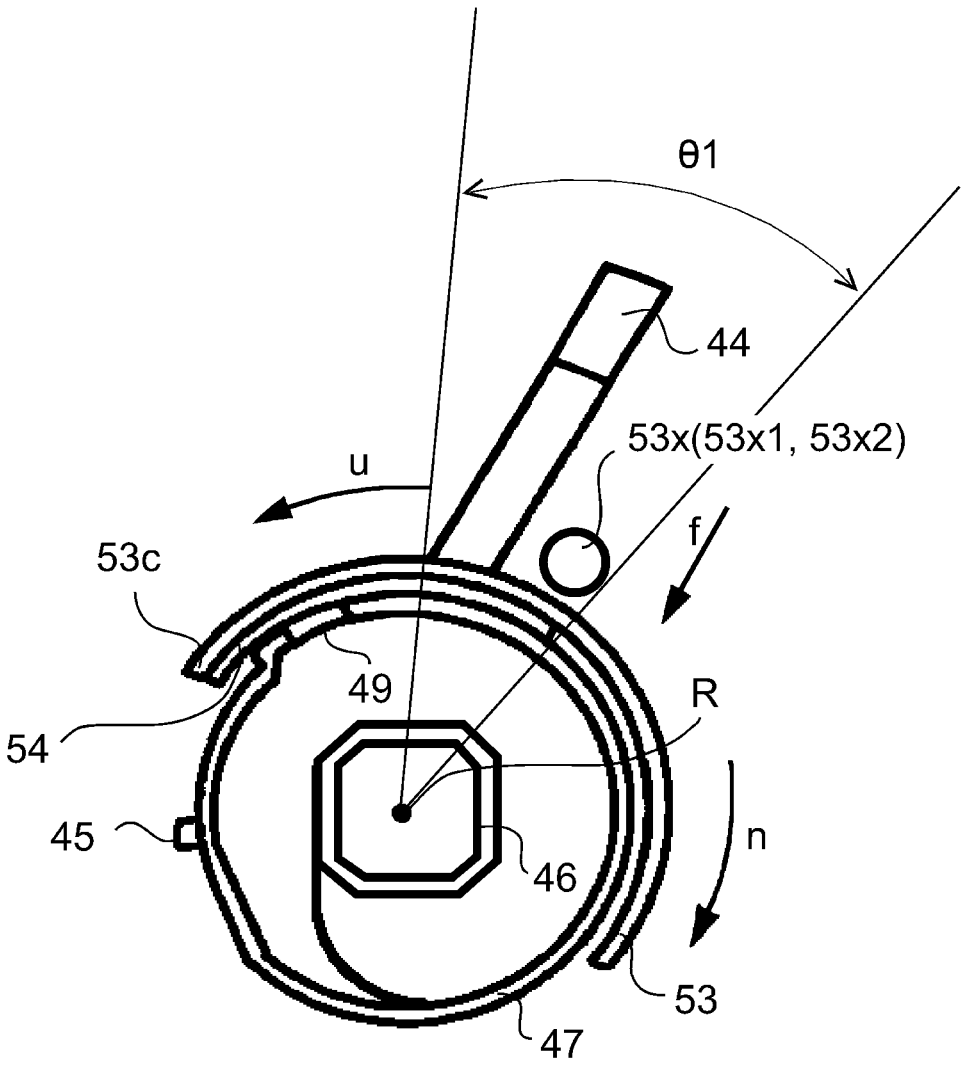

FIG. 19 is an illustration of an arrangement relationship of a second shutter.

DESCRIPTION OF THE EMBODIMENTS

In the following, using the drawings, an image forming apparatus for forming an electrophotographic image, a toner image forming portion and a toner cartridge will be described. Here, an image forming apparatus is an apparatus for forming an image on a recording material with using, for example, an electrophotographic image forming process. For example, it includes an electrophotographic copying machine, an electrophotographic printer (for example, a LED printer, a laser beam printer, and so on), an electrophotographic facsimile machine, and the like.

Here, in the following examples, a monochromatic image forming apparatus provided with one toner image forming portion is illustrated. However, the number of toner image forming portions provided in the image forming apparatus is not limited to such an example. For example, the image forming apparatus may have a plurality of toner image forming portions to form a color image.

Similarly, with respect to each constitution disclosed in the embodiments, materials, arrangement, dimensions, other numerical values and the like are not limited to the described examples unless otherwise described. In addition, unless otherwise specified, "above" means upward in the direction of gravity when the image forming apparatus is installed.

Embodiment 1

In this embodiment, a structure that contributes to improvement of usability will be described in detail. More specifically, it relates to an improvement in the operation feeling when the user mounts the toner cartridge to the developing unit.

First, the structure of the entire image forming apparatus will be described, and thereafter, the developing unit and the toner cartridge will be described in detail. Here, the operation of mounting the toner cartridge to the developing unit is referred to as a mounting operation, and the operation of dismounting the toner cartridge from the developing unit is referred to as a dismounting operation.

In addition, the position at which the projection, the hole, and so on are engaged with each other is referred to as the engagement position, and the position at which the engagement is released is referred to as the non-engagement position (disengagement position).

[Description of Electrophotographic Image Forming Apparatus]

Figure 2:
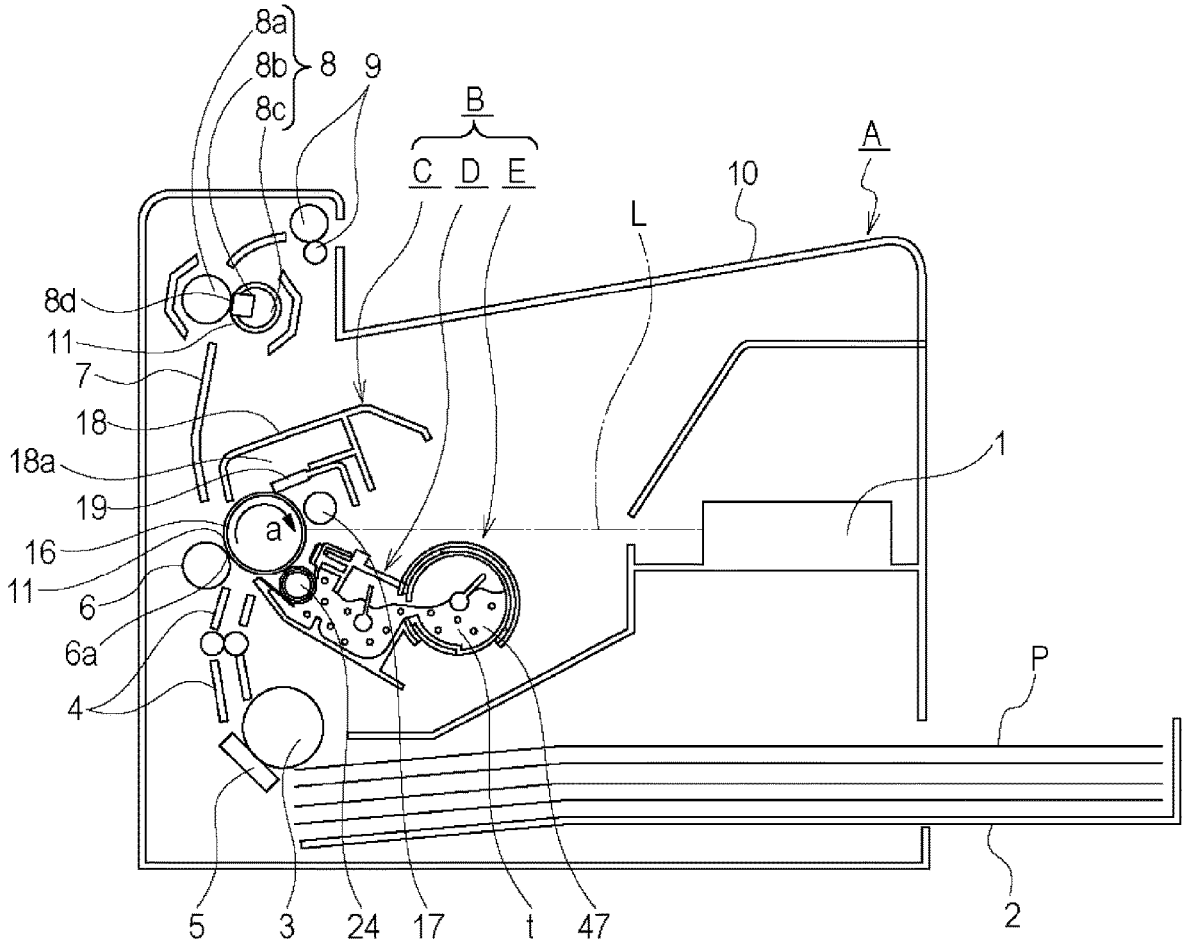
FIG. 2 is a cross-sectional view schematically showing a structure of an image forming apparatus according to an embodiment.

FIG. 2 is a side sectional structure illustration of the structure of the image forming apparatus A according to this embodiment. The image forming apparatus A shown in FIG. 2 receives image information from an external device such as a personal computer which is communicatably connected therewith. And, according to received image information, the image forming apparatus A forms an image (toner image) with a developer (toner) on a recording material P (for example, recording sheet, OHP sheet, cloth, and so on) through an electrophotographic image forming process.

A toner image forming portion (toner image forming unit) B is dismountably provided in the main assembly of the image forming apparatus A. The toner image forming unit (toner image forming unit) B of this embodiment comprises a drum unit C, a developing unit (developing device) D, and a toner cartridge E. The toner cartridge E can be mounted to and dismounted from the developing unit D. That is, the developing unit D has a mounting portion for mounting the toner cartridge E, and is a receiving device (receiving device) for receiving the toner cartridge E.

Here, the toner image forming unit (toner image forming unit) B can be regarded as a unit including the photosensitive drum 1 and elements (process members) acting on the photosensitive drum.

The drum unit C and the developing unit D are integrated, and can be dismountably mounted to the main assembly of the image forming apparatus as one cartridge. A cartridge in which the drum unit C and the developing unit D are integrated is sometimes called a process cartridge in particular. That is, the toner cartridge E is mounted to and dismounted from the developing unit D of the process cartridge. In this case, the receiving device is a device which receives the entire process cartridge.

In addition, with the toner cartridge E mounted on the developing unit D, the process cartridge is mountable to and dismountable from the apparatus main assembly. That is, the drum unit C, the developing unit D, and the toner cartridge E can be mounted to and dismounted from the apparatus main assembly in a state of being integrated. Therefore, a toner image forming portion (toner image forming unit) B including all of the drum unit C, the developing unit D, and the toner cartridge E may be referred to as a process cartridge.

Here, the drum unit C, the developing unit D, and the toner cartridge E may be individually formed into respective cartridges. In this case, the drum unit C is called a drum cartridge, and the developing unit D is called a developing cartridge. In addition, in some cases, the photosensitive drum (or the drum unit including the photosensitive drum) is fixed to the main assembly of the apparatus, and only the developing unit (developing cartridge) D and the toner cartridge E are dismountable.

In addition, the photosensitive drum or the developing unit may be fixed to the apparatus main assembly, and only the toner cartridge E may be dismountably mounted to the apparatus main assembly. In such a case, the image forming apparatus itself can be regarded as a receiving device for the toner cartridge E.

In addition, the combination of the receiving device and the toner cartridge E may be referred to as a toner supply mechanism (toner supply unit, toner supply device) or the like. In the toner supply mechanism, the toner is supplied (replenished) from the toner cartridge E to the developing unit D provided in the receiving apparatus.

Here, in this example, a photosensitive drum as an image bearing member has a structure in which a flange or the like is integrated with a cylinder having a photosensitive layer.

Mounting and dismounting of each cartridge is performed by the user (operator). In addition, the main assembly of the apparatus (main assembly of the image forming apparatus) refers to the constitutional portion excluding these cartridges (drum unit C, developing unit D, toner cartridge E) from the image forming apparatus A.

The drum unit C is a unit integrally including a photosensitive drum (image bearing member) 16, a charging roller 17, a cleaning blade 19, and the like, and in this embodiment, it is connected to the developing unit D to constitute a portion of the process cartridge. In addition, the developing unit D is a unit including integrally a developing roller (developer carrying member) 24 and the like, and in this embodiment, it is a portion of the process cartridge. The toner cartridge E is a cartridge integrally including a toner container (developer accommodating container, container) 47 for containing toner t as a developer.

The photosensitive drum 16 rotates in the direction of the arrow a shown in FIG. 2. A surface of rotating photosensitive drum 16 is uniformly charged by the charging roller 17 as charging means. The laser beam L corresponding to the image information is irradiated from the laser scanner (exposure means) 1 onto the photosensitive drum 16 by which an electrostatic latent image corresponding to image information is formed on the photosensitive drum 16. And, the toner t carried on the developing roller 24 develops the electrostatic latent image. By this, a toner image is formed on the photosensitive drum 16.

Figure 3:
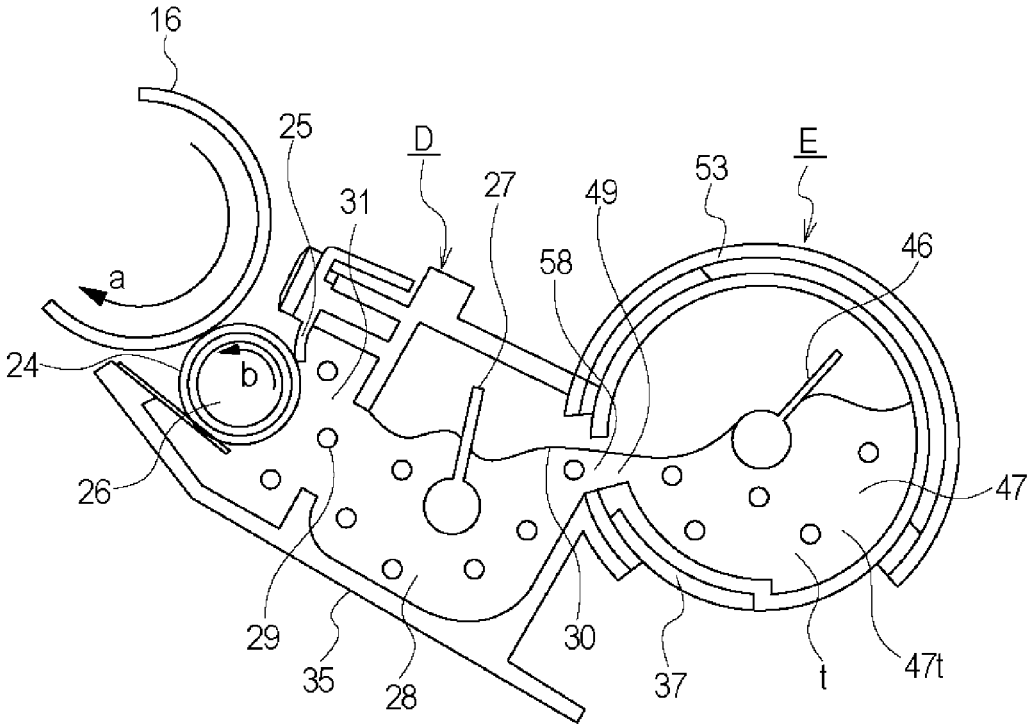
FIG. 3 is a schematic side sectional view illustrating a state in which the toner cartridge is mounted on the developing unit.

Here, referring to FIG. 3, the developing process in the toner image forming portion B will be described. A frame 35 of the developing unit D as the receiving apparatus rotatably supports the developing roller 24. The developing roller 24 receives a driving force from a power source such as a motor (not shown) provided in the main assembly of the apparatus and is rotationally driven in a forward direction (a direction of arrow b in the drawing) with respect to the photosensitive drum 16.

A thickness t of the toner tin the developing chamber 31 is discharged regulated by the developing blade 25 and is carried on a circumferential surface of the developing roller 24. During the layer thickness being regulated, electric charge is imparted to the toner by triboelectrical charging. And, the charged toner develops the electrostatic latent image on the photosensitive drum 16.

In the developing unit D, the developing chamber 31 communicates with the first toner containing portion (developer accommodating portion) 28 through the first opening portion 29. A first toner feeding means 27 which is rotationally driven by the driving source (not shown) supplies the toner t from the first toner containing portion 28 to the developing chamber 31.

In addition, a communicating portion 58 is formed by a second opening portion (containing body opening, receiving opening, receiving opening) 30 and a third opening portion (container opening, discharge opening, discharge opening) 49. Through this communication portion 58, the first toner containing portion (containing member accommodating chamber) 28 is in fluid communication with the second toner containing portion (container accommodating chamber) 47*t* of the toner cartridge E.

The second toner container portion 47*t* is a space provided inside the container 47 for containing the toner.

A third opening portion 49 is formed in the container frame 47*a*, and is a discharge opening for discharging the toner from the second toner container portion 47*t* to the outside of the container 47 (that is, into the developing unit D). The toner discharged from the third opening portion 49 is received in the second opening (receiving port) 30 of the developing unit D.

The toner t is supplied from the second toner container portion 47*t* into the first toner container portion 28 by the second toner feeding member 46 which rotates by the driving force inputted from the apparatus main assembly by way of the developing unit D.

Referring back to FIG. 2, the description will be made further. The recording material P contained in the feeding cassette 2 is separated and fed one by one by the cooperation of the pickup roller 3 and the pressure contact member 5 pressed against the pickup roller 3. And, in synchronization with the toner image formed on the photosensitive drum, the recording material P is fed along the feeding guide 4 to the transfer roller 6 as a transfer means.

Next, the recording material P passes through the transfer nip portion 11 formed by the photosensitive drum 16 and the transfer roller 6 to which a predetermined voltage is applied. At this time, the toner image formed on the photosensitive drum 16 is transferred onto the recording material P. The recording material P onto which the toner image has been transferred is fed to a fixing means 8 by a feeding guide 7.

The fixing means 8 includes a driving roller 8*a* and a fixing roller 8*c* incorporating a heater 8*b* therein. The recording material P receives heat and pressure when passing through the nip portion 8*d* formed between the fixing roller 8*c* and the driving roller 8*a*. By this, the toner image transferred onto the recording material P is fixed thereon. Thereafter, the recording material P on which the toner image has been fixed is fed by a pair of discharge rollers 9 and discharged to a discharge tray 10.

The cleaning blade 19 is elastically in contact to the outer peripheral surface of the photosensitive drum 16. By this, the toner t (untransferred residual toner) remaining on the photosensitive drum 16 which has not been transferred onto the recording material P is scraped off by the cleaning blade 19. The scraped toner t is stored in the removed toner containing portion (waste toner containing portion) 18*a* of the frame 18 to which the cleaning blade 19 is fixed.

As described in the foregoing, in the image forming apparatus of this embodiment, an image is formed on a recording material (recording material) by using a developer (toner) through an electrophotographic image forming method. The image forming apparatus will suffice if it can form an image on a recording material, and its form is not limited to an electrophotographic copying machine, an electrophotographic printer (a laser beam printer, a LED printer, and so on), an electrophotographic facsimile machine, an electrophotographic word processor, or the like.

As described in the foregoing, the toner image forming portion B includes the electrophotographic photosensitive member (photosensitive member) which is the image bearing member and the process means acting on the photosensitive member. In this embodiment, this toner image forming portion can be dismountably mounted to the main assembly of the image forming apparatus as one or more cartridges.

The process means includes charging means (charging member, charging device), developing means (developing device, developing unit), cleaning means (cleaning device, cleaning member) and the like.

The developing device develops the electrostatic latent image on the photosensitive member. In this embodiment, the developing device (developing unit) can be mounted to and dismounted from the image forming apparatus as a portion of the process cartridge.

In addition, the toner cartridge (developer cartridge, toner bottle, developer bottle, toner container, developer container) is a cartridge containing the developer (toner) used for developing the electrostatic latent image formed on the photosensitive member.

[Structure of Each Cartridge (Each Unit)]

Next, a detailed structure of each cartridge (each unit) dismountably provided in the image forming apparatus will be described.

(Details of Neighborhood of Toner Cartridge Receiving Portion of Developing Unit)

Referring to FIG. 4, a detailed structure of the neighborhood of the receiving portion of the toner cartridge E of the developing unit D according to this embodiment will be described. FIG. 4 is a perspective view of the neighborhood of the receiving portion (mounting portion) of the toner cartridge E of the developing unit D. Part (a) of FIG. 4 shows a state in which the second opening portion 30 is closed (the first shutter 37 is in the closed position). In addition, part (b) of FIG. 4 illustrates a state in which the second opening portion 30 is opened (the first shutter 37 is in the open position). In this embodiment, the longitudinal direction of the developing unit D is a direction parallel to the rotational axis direction of the developing roller 24 of the developing unit D. Here, in a state in which the toner cartridge E is mounted to the developing unit, the longitudinal direction of the toner cartridge E is substantially parallel to the longitudinal direction of the developing unit D.

In the developing unit D, the toner cartridge E can be mounted (removable) to the frame (developing frame) 35 at the receiving portion. In the neighborhood of the receiving section, the developing unit D is provided with the second opening (containing body opening, receiving port) 30 and the first shutter (containing body shutter, receiving apparatus side shutter, receiving apparatus side opening/closing member) 37. In this embodiment, the second opening portion 30 is provided in the center portion in the longitudinal direction of the developing unit D. However, the position of the second opening portion 30 is not limited to this position as long as it faces the third opening (container opening) 49 which will be described hereinafter.

As shown in part (a) of FIG. 4, the second opening portion 30 is sealed by a first shutter 37 having a shape with a curvature along the outer peripheral surface of the toner cartridge E.

The first shutter 37 has a hole portion 37*a* engageable with a projection (a container side engaging portion, an opening/closing member moving portion, a container side projection) 45 provided on the toner cartridge E. Two projections 45 and two hole portions 37 are provided. The hole 37 is provided outside a sealed area where the first shutter 37 seals the second opening portion 30.

In addition, both end portions in the longitudinal direction of the first shutter 37 are engaged with a first shutter guide portion 34 provided in the frame 35 of the developing unit D. By this, the first shutter 37 is slidable (movable) along the first shutter guide portion 34 (in the directions of arrows W1 and W2).

By this, the first shutter 37 is movable between the closing position for closing the second opening portion 30 (the receiving opening closing position, part (a) of FIG. 4) and the open position for opening the second opening portion 30 (the inlet opening position, part (b) of FIG. 4).

In addition, as shown in part (b) of FIG. 4, a first sealing seal 32 for sealing the space between the first shutter 37 and the second opening portion 30 is mounted to the frame 35 of the developing unit D so as to surround the second opening portion 30.

The developing unit D is provided at opposite ends of the frame 35 in the longitudinal direction with insertion guide portions (receiving device side guides) 35*d*, 36*d* for guiding while maintaining the attitude (mounting attitude) of the toner cartridge upon mounting (insertion) of the toner cartridge E.

In addition, the developing unit D is provided with abutted portions (portions to be abutted to) 35*a*, 36*a* against which the abutting portions 42*a*, 43*a* of the toner cartridge E abut when a toner cartridge E is inserted as will be described hereinafter.

Furthermore, the developing unit D is provided at opposite ends of the frame 35 in the longitudinal direction with rotation guide portions 35*b*, 36*b* for guiding the rotation of the toner cartridge E when opening and closing the first shutter 37 and the second shutter (toner cartridge side shutter) 53.

The insertion guide portions 35*d*, 36*d* are formed linearly and parallel to each other along the inserting direction f (part (a) of FIG. 4) of the toner cartridge E. Here, the direction in which the toner cartridge E is inserted and the opposite direction thereto may be referred to as a removal direction. The removal direction is the direction to remove the toner cartridge E from the developing unit D. The downstream side in the inserting direction can be regarded as the upstream side in the removal direction, and the upstream side in the inserting direction can be regarded as the downstream side in the removal direction.

Regarding the opposite end sides in the longitudinal direction of the developing unit D, the side on which the drive unit such as a gear (e.g. The first drive transmission portion 38) is disposed is hereinafter referred to as a drive side. The non-driving side of the developing unit is opposite to the driving side in the longitudinal direction.

On the non-driving side of the developing unit D, the abutted portion (portion to be abutted to) 35*a* and the rotation guide portion 35*b* are provided on the downstream side in the inserting direction f of the insertion guide portion 35*d*, and on the driving side, the abutted portion (portion to be abutted to) 36*a* and the rotation guide 36*b* are provided on the downstream side in the inserting direction f of the insertion guide portion 36*d*.

Furthermore, the developing unit D is provided with a first drive transmission portion 38 for transmitting drive to the second toner feeding unit 46 of the toner cartridge E which will be described hereinafter, at one end in the longitudinal direction of the frame 35.

The first drive transmission portion 38 is a gear, and is connected to the driving mechanism of the image forming apparatus main assembly, inside the developing unit D. The first drive transmission portion 38 is a torque transmission unit (drive force transmission unit) for transmitting the rotational force for driving the second toner feeding member 46, from the outside of the toner cartridge E.

(Detailed Description of Toner Cartridge)

Referring to FIG. 5, a detailed structure of the toner cartridge E according to this embodiment will be described.

Part (a) of FIG. 5 is a perspective view of the toner cartridge E as viewed from the second drive transmission portion (48) side (drive side). In addition, part (b) of FIG. 5 is a perspective view of the toner cartridge E as viewed from the side (non-driving side) opposite to the second drive transmission portion (48) side. Part (c) of FIG. 5 is a cross-sectional view of the toner cartridge E in the closed state of the third opening portion 49 as viewed from the side opposite to the second drive transmission portion (48) side. In addition, part (d) of FIG. 5 is a sectional view of the toner cartridge E in the state that the third opening portion 49 is opened, as viewed from the side opposite to the second drive transmission portion (48) side. And, part (e) of FIG. 5 is a perspective view of the toner cartridge E when the second shutter 53 is in the open position (state in which the third opening portion 49 is opened). Here, in FIG. 5, the toner t is not shown.

The toner cartridge E includes the container 47, the second shutter (developer container shutter) 53 movable with respect to the container 47, the second toner feeding member 46 provided inside the container 47, and the second drive transmission portion (gear) 48 mounted to the second toner feeding member 46, and the like.

The container 47 has a substantially cylindrical shape. That is, the frame (container frame) 47*a* constituting the main assembly portion (main portion) of the container 47 has a substantially cylindrical shape. Here, the longitudinal direction of the toner cartridge E is the longitudinal direction (axial direction) of the cylindrical shape.

An insertion guided portion (guided portion, cartridge side guide portion) 42 projecting outward in the longitudinal direction beyond the side wall 47*a*2 of the container frame 47*a* is provided at the end portion of the container 47 in the longitudinal direction. Similarly, at the other longitudinal end portion of the container 47, an insertion guided portion (guided portion, cartridge side guide portion) 43 projecting outward in the longitudinal direction beyond the side wall 47*a*1 of the container frame 47*a* is provided.

In addition, the container 47 is provided with an operating portion 44 to be operated by the user. The operating portion 44 is a U (U-shaped) projection integrally formed with the frame 47*a*. Here, the shape of the operating portion 44 is not limited to the U shape. In addition, it may be integrally molded with the container frame 47*a* or may be made of a member separate from the frame 47*a* and is mounted to the frame 47*a*. The operating portion 44 is a holding portion (grip, gripping) for the user to grip when inserting or removing the toner cartridge E.

As shown in part (c) of FIG. 5, the container frame (cylindrical portion) 47*a* is hollow, and forms a second toner container portion 47*t* in which toner is stored. A second toner feeding member 46 for feeding the toner is rotatably provided inside the second toner container portion 47*t* of the container frame 47*a*. The second drive transmission portion 48 for receiving the power (rotational force, driving force) for rotationally driving the second toner feeding member 46 is provided at one end portion in the longitudinal direction (rotational axis direction) of the second toner feeding member 46 (part (a) of FIG. 5). The second drive transmission portion 48 is a gear (drive input gear) which receives the driving force (rotational force) from the outside of the toner cartridge E (that is, from the developing unit D as the receiving device).

Here, in this embodiment, the driving force is directly transmitted from the second drive transmission portion 48 to the second toner feeding member 46. However, the driving force may be transmitted from the second driving force transmitting portion 48 to the second toner feeding member 46 through another drive transmitting member (for example, one or a plurality of gears). Such a structure will be described hereinafter, referring to FIG. 15.

In addition, as shown in part (e) of FIG. 5, a third opening portion 49 for discharging the toner t of the second toner container portion 47*t* is provided in the peripheral surface of the container frame 47*a*. In this embodiment, the third opening portion 49 is provided in the outer peripheral surface of the container frame 47*a* at the center in the longitudinal direction of the toner cartridge E. However, the position of the third opening portion 49 is not limited to a specific position as long as it is a position facing the second opening portion 30.

As shown in part (c) of FIG. 5, a cross portion of the second shutter 53 (section along a plane perpendicular to the center axis R of the container frame 47*a*) has a curved shape (substantially circular arcuate shape) along the outer circumference of the container frame 47*a*.

The container frame 47*a* has a curved surface (substantially cylindrical shape, substantially circular arc shape) at least around the third opening portion 49. The second shutter 53 is rotatable (revolvable) around the container frame 47*a* along a curved surface portion (circular arcuate portion) around the third opening portion 49. By this, the second shutter 53 can open and close the third opening portion 49.

The second shutter 53 has a shutter body portion 53*m* (body portion, closing portion) for closing the third opening portion 49. Here, the longitudinal direction of the shutter body 53*m* is substantially parallel to the longitudinal direction of the toner cartridge E.

In addition, the second shutter 53 is provided with an extending portion 53*x* extending in the longitudinal direction. A restricting portion 53*x*1 projecting outward in the longitudinal direction beyond the side wall 47*a*1 of the container frame 47*a* is provided at the end portion in the longitudinal direction of the extending portion 53*x*. Similarly, a restricting portion 53*x*2 projecting outward in the longitudinal direction beyond the side wall 47*a*2 of the container frame 47*a* is provided at the other longitudinal end portion of the extending portion 53*x* (Parts (a) and (b) of FIG. 5).

In addition, the state in which the second shutter 53 is opened (part (d) in FIG. 5) changes from the state where the third opening portion 49 is closed (part (c) in FIG. 5). At this time, the extending portion 53*x* and the restricting portions 51*x*1 and 51*x*2 are disposed away from the operating portion 44.

More specifically, when the second shutter 53 is relatively moved from the state shown in part (c) of FIG. 5 in the arrow n direction with respect to the container frame 47*a*, the third opening portion 49 is opened from the closed state (part (d) of FIG. 5). At this time, the extending portion 53*x* provided in the second shutter 53 also moves in the arrow n direction with respect to the container frame 47 similarly to the second shutter 53. That is, when the second shutter 53 becomes in a state where it is opened from a state in which the third opening portion 49 is closed, the extending portion 53*x* moves away from the operating portion 44.

In addition, when the second shutter 53 becomes in a closed state from the state in which the third opening portion 49 is opened, the extension portion 53*x* approaches to the operating portion 44.

Here, in this example, although the extended portion 53*x* is formed integrally with the second shutter 53, it may be formed separately. In addition, at least a portion of the extended portion 53*x* may be made of a member (metal rod or the like) having a higher strength than that of a portion other than the extending portion 53*x*.

And, two projections 45 are provided on the cylindrical outer periphery of the container frame 47*a* so as to be engageable with the hole portion 37*a* of the first shutter 37. The two projections 45 project substantially in the same direction. The two projections 45 project toward the downstream side in the inserting direction in which the toner cartridge E is inserted into the developing unit D. In addition, a line connecting the two projections 45 is substantially parallel to the longitudinal direction of the toner cartridge E.

In addition, the end portion 53*c* on the free end side of the second shutter 53 is on the downstream side, in the direction (arrow u direction) in which the second shutter 53 moves with respect to the container frame 47*a* when closing the third opening portion 49. The end portion 53*c* on the free end side of the second shutter 53 is the end portion in the lateral direction of the second shutter 53 (the direction perpendicular to the longitudinal direction of the second shutter 53).

As shown in part (c) of FIG. 5, the toner cartridge E is seen along the longitudinal direction. The state in which the second shutter 53 is opened from the state (part (b) of FIG. 5) becomes the state in which the third opening portion 49 is closed (part (e) in FIG. 5). At this time, the two projections 45 are arranged on the side remote from the end portion 53*c* on the free end side of the second shutter 53.

In the longitudinal direction of the container 47, the two projections 45 are arranged outside the third opening portion 49. In more detail, as projecting the two projections 45 and the third opening portion 49 onto an imaginary line parallel to the center axis R of the container frame 47*a* which is the rotation axis of the second shutter 53, the entire projection area of the third opening portion 49 falls within the range sandwiched between the projection areas of the two projections.

The opposite end portions 53*n* in the longitudinal direction of the second shutter 53 (shutter body portion 53*m*) are engaged with second shutter guide portions (opening and closing guides) 52 provided on opposite sides of the container frame 47*a* in the longitudinal direction of the third opening portion 49. And, the shutter body 53*m* of the second shutter 53 is assembled along the second shutter guide portion 52 so as to be slidable in the circumferential direction on the outer peripheral surface of the container frame 47*a*. By this, the second shutter 53 is movable between the opening position (container open position, par (e) of FIG. 5) for opening the third opening portion 49 along the outer circumferential surface of the toner cartridge E, and closing position for closing the third opening portion 49 (container closing position, part (b) of FIG. 5).

Here, it is preferable that when the second shutter 53 is in the open position, as shown in part (e) of FIG. 5, the third opening portion 49 is entirely opened from the shutter body portion 53*m* (closed portion). However, if the toner t can be discharged by the required amount from the third opening portion 49 when the second shutter 53 is in the open position, a portion of the third opening portion 49 may be covered by the shutter body portion 53*m* (closed portion). That is, it will suffice if when the second shutter 53 is in the open position, the shutter body 53*m* at least partially opens the third opening portion 49, so that the toner t can be supplied from the toner cartridge E to the developing unit D.

In addition, it is preferable that when the second shutter 53 is in the closed position, as shown in part (b) of FIG. 5, the third opening portion 49 is entirely covered by the shutter body portion 53*m*. However, the third opening portion 49 may be slightly opened provided that the third opening portion 49 is substantially closed by the shutter body portion 53*m* and toner leakage from the third opening portion 49 is sufficiently suppressed. That is, it suffices if the shutter body 53*m* substantially closes the third opening portion 49 when the second shutter 53 is in the closed position.

(Modified Example of Operating Portion)

Here, referring to FIG. 13, a modified example of the structure of the operating portion 44 will be described.

As shown in part (a) of FIG. 13, the shape of the operating portion 44 may be in the form of a projection provided at each of the opposite longitudinal ends of the frame 47*a*. In addition, as shown in part (b) of FIG. 13, the operating portion 44 is not necessarily provided at both longitudinal ends of the frame but may be projections provided at one longitudinal end. Here, in this embodiment, the operating portion 44 is formed integrally with the frame 47*a*, but it may be made of a member different from the frame 47*a* and is mounted to the frame 47*a*.

It is preferable that the operating portion 44 is disposed on the container frame 47*a* outwardly beyond the extending portion 53*x* (the restricting portions 53*x*1, 53*x*2) in the longitudinal direction.

[Mounting of Toner Cartridge to Developing Unit]

Next, the process of mounting the toner cartridge E to the developing unit D will be described. With the toner cartridge E having been inserted in the developing unit D, the toner cartridge E is rotated so that the second opening portion 30 and the third opening portion 49 are opened and closed.

(Insertion Operation of Toner Cartridge into Developing Unit)

Figure 1:
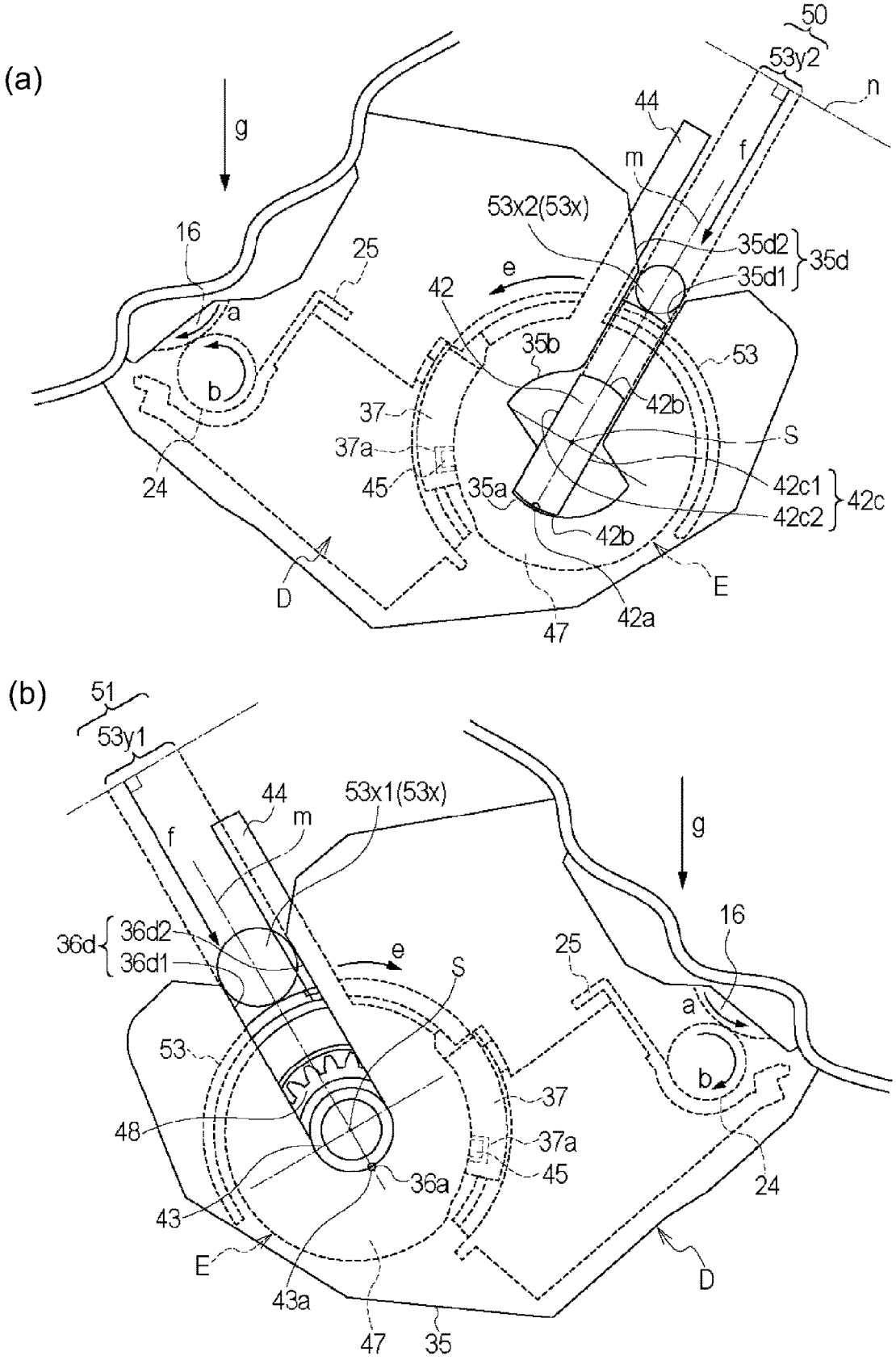

Referring to FIG. 1, FIG. 6, and FIG. 7, the operation of inserting the toner cartridge E into the developing unit D will be described. Here, FIG. 1, part (b) of FIG. 6 and FIG. 7 are views through the insertion guide portions 35*d* and 36*d* for the sake of better illustration.

Part (a) of FIG. 1 is a side view when the toner cartridge E is inserted into the developing unit D, as viewed from the non-driving side. Part (b) of FIG. 1 is a side view of the toner cartridge E and the developing unit D as viewed from the driving side and indicates the positional relationship of the operating portion 44 and the abutment portion 43*a* with respect to the mounting direction of the toner cartridge E.

FIG. 6 is a schematic illustration showing states of the toner cartridge E and the developing unit D before the toner cartridge E is mounted (inserted), and part (a) of FIG. 6 is a perspective view thereof, and part (b) of FIG. 6 is a side view thereof.

FIG. 7 is a side view illustrating the state of the toner cartridge E and the developing unit D in the middle of mounting (insertion) process of the toner cartridge E.

As shown in part (a) of FIG. 1, the toner cartridge E includes a rotation guided portion (portion to be guided for rotation) 42*b*. This rotation guided portion 42*b* guides the container frame 47*a* when opening and closing the first shutter 37 and the second shutter 53 by rotating the toner cartridge E. The container 47 can be rotated smoothly by the rotation guided portion 42*b*. The rotation guided portion 42*b* is a rotation guide (toner cartridge side rotation guide) for guiding the rotation of the toner cartridge E. The rotation guided portion 42*b* has a curved surface shape (substantially circular arcuate shape) (details will be described hereinafter).

In this embodiment, on the non-driving side, the abutting portion 42*a*, the rotation guided portion 42*b*, the restricting portion 42*c*1, and the restricting portion 42*c*2 are formed integrally with the insertion guided portion 42. However, they may be provided as separate members as long as they satisfy the respective functions.

As shown in part (b) of FIG. 1, the insertion guided portion 43 is provided with an abutting portion 43*a* abutting against an abutted portion 36*a* of the developing unit D when toner cartridge E is inserted. The structure is such that the insertion guided portion 43 also serves as a rotated guide portion (toner cartridge side rotation guide portion) for guiding the container frame 47*a* when the abutting portion 43*a* opens and closes the first shutter 37 and the second shutter 53.

In this embodiment, on the driving side, the insertion guided portion 43 and the abutment portion 43*a* may be constituted by separate members. In addition, the rotated guide portion may be provided as a separate member from the abutting portion 43*a*. As described above, the portions (non-functional portions, non-contact portions) where the toner cartridge E and the developing unit D do not abut each other may be appropriately omitted, based on the consideration of the strength and the like.

In addition, in this embodiment, the insertion guided portion 43 is provided at the end portion of the second drive transmission portion 48 at the end portion in the longitudinal direction of the second toner feeding portion 46. However, the insertion guided portion 43 may be provided on the container frame 47*a*.

Here, referring to part (a) of FIG. 1, the arrangement of the operating portion 44 in the container frame 47*a* will be described. This Figure shows a positional relationship between the operating portion 44 and the abutting portion 42*a* in the inserting direction f.

Here, the inserting direction f will be described. The direction along the plane of the restricting portion 42*c* is defined as an f direction. More specifically, in the direction along the surface of the restricting portion 42*c*, the direction in which the abutting portion 42*a* is on the downstream side with respect to the insertion guided portion 42 can be said to be the f direction. That is, the direction in which the toner cartridge E is inserted into the developing unit D is the f direction.

A plane (imaginary plane passing through a rotation center S of the container frame 47*a*) which is parallel to the inserting direction f of the toner cartridge E regulated by the restricting portion 42*c*1 and the restriction portion 42*c*2 and which passes through the abutting portion 42*a* and the abutting portion 43*a* is assumed to be a plane m.

The operating portion 44 is provided on a downstream side of the plane m in the opening direction (direction e in part (a) of FIG. 1) of the third opening portion 49 (part (d) of FIG. 5). Here, the opening direction (direction of arrow e) of the third opening portion 49 is a direction (setting direction) in which the toner cartridge E is rotated in order to set the toner cartridge E to the developing unit D.

In addition, the arrangement of the restricting portion (engaging portion) 53*x*1 and the restricting portion (engaging portion) 53*x*2 provided on the longitudinal end portions of the extending portion 53*x* with respect to the container frame 47*a* will be described. As shown in part (a) of FIG. 1, the insertion guided portion 42, the restriction portion 53*x*1, and the restriction portion 53*x*2 are arranged in a predetermined direction (inserting direction f or removal direction). That is, the insertion guided portion 42, the restriction portion 53*x*1, and the restriction portion 53*x*2 are arranged in a straight line along the inserting direction f (or removal direction). In addition, the restricting portion 53*x*1 and the restricting portion 53*x*2 are arranged on the upstream side of the insertion guided portion 42 in the inserting direction f.

In addition, the insertion guided portion 42 is arranged as a single body extended along the predetermined direction (the inserting direction f or the removal direction). That is, the insertion guided portion 42 extends along the inserting direction f (or removal direction).

The arrangement of the insertion guided portion 42, the restricting portion 53*x*1, and the restricting portion 53*x*2 will be described in more detail below. An imaginary line (first imaginary line) extending perpendicularly to the inserting direction f of the toner cartridge E as the toner cartridge E is viewed along its longitudinal direction is n. As the insertion guided portion 42 and the restriction portion 53*x*2 are projected on the line n, respectively, the projection area 53*y*2 of the restricting portion 53*x*2 falls within the projection area 50 of the insertion guided portion 42. Here, it is not necessary that all of the projection area 53*y*2 of the restricting portion 53*x*2 is within the projection area 50 of the insertion guided portion 42, but at least a portion thereof is within it.

Similarly, as shown in part (b) of FIG. 1, when the insertion guided portion 43 and the restriction portion 53*x*1 are projected on the linen, respectively, the projection area 53*y*1 of the restriction portion 53*x*1 falls within the projection area 51 of the insertion guided portion 43. It is not necessary for all of the projection area 53*y*1 of the restricting portion 53*x*1 to be included in the projection area 51 of the insertion guided portion 43, and it is sufficient if at least a portion thereof is within it.

With such a structure, in a state in which the toner cartridge E is mounted to the developing unit D, the restricting portion 53*x*2 and the restricting portion 53*x*1 can be engaged with the insertion guide portion 35*d* and the insertion guide portion 36*d*, respectively (details will be described hereinafter).

Here, if the restricting portions 53*x*1, 53*x*2 are disposed as described above, it is not necessary to arrange the extended portion 53*x* in a straight line in the longitudinal direction, and it may have a crank shape or the like (FIG. 14).

Next, the operation of inserting the toner cartridge into the developing unit will be described.

As shown in part (a) of FIG. 6, before the toner cartridge E is mounted to the developing unit D, the first shutter 37 is in the closed position for the second opening portion 30 (not shown), and the second shutter 53 is in the closed position of the third opening portion 49 (not shown). That is, the second opening portion 30 (part (a) of FIG. 4) of the developing unit D and the third opening portion 49 (part (d) of FIG. 5) of the toner cartridge E are closed by the first shutter 37 and the second shutter 53.

On the insertion guided portion 42 of the toner cartridge E, a restricted portion (regulated surface, attitude restricting portion, inserting direction restricting portion) 42*c*1 and 42*c*2 for regulating the insertion attitude and removal attitude (inserting direction, removal direction) of the toner cartridge E are provided.

The user grips the operating portion 44 and moves the toner cartridge E with respect to the developing unit D in the inserting direction f. The user moves the toner cartridge E such that the insertion guided portion 42 of the toner cartridge E and the insertion guide portion 35*d* of the developing unit D engage with each other, and the insertion guided portion 43 and the insertion guide portion 36*d* engage with each other. As the insertion guided portions 42, 43 are guided by the insertion guide portions 35*d*, 36*d* of the developing unit D, the attitude of the toner cartridge E when the toner cartridge E is being mounted is stabilized.

Here, as shown in part (b) of FIG. 6, in this embodiment, the insertion guided portions 42, 43 and the insertion guide portions 35*d*, 36*d* are constituted so that the inserting direction f is oblique to the gravity direction g.

In other words, the toner cartridge E is inserted while the restricting portion 42*c*1 on the lower side in the gravity direction g of the insertion guided portion 42 and a surface 35*d*1 on the lower side in the gravity direction g of the insertion guide portion 35*d* are in contact with each other (part (a) in FIG. 1). Similarly, the toner cartridge E is inserted while the restricting portion 42*c*2 on the lower side in the gravity direction g of the insertion guided portion 42 and a surface 35*d*2 on the lower side in the gravity direction g of the insertion guide portion 35*d* are in contact with each other (part (b) of FIG. 1).

And, as shown in FIG. 7, the restricting portion 42*c*1 on the lower side (in the gravity direction g) of the insertion guided portion 42 is placed on the surface 35*d*1 of the insertion guide portion 35*d*, so that the position of the insertion guided portion 42 is determined relative to the rotation guide portion 35*b*. By this, the attitude of the toner cartridge E relative to the developing unit D is determined.

As the user further moves the toner cartridge E in the f direction while maintaining its attitude, as shown in part (a) of FIG. 1, the abutting portion 42*a* of the insertion guided portion 42 provided in the toner cartridge E abuts against the abutted portion 35*a* provided in the developing unit D. Similarly, as shown in part (b) of FIG. 1, the abutting portion 43*a* provided on the toner cartridge E abuts against the abutted portion 36*a* provided in the developing unit D. By this, the insertion of the toner cartridge E is completed.

In addition, in the course of mounting the toner cartridge E to the developing unit, at least a part of the restricting portion 53$x$2 enters the insertion guide portion 35$d$. Similarly, at least a part of the restricting portion 53$x$1 enters the insertion guide portion 36$d$.

(Modified Example of Inserted Guide Portion)

Here, referring to part (a) of FIG. 8, part (b) of FIG. 8, part (c) of FIG. 8, a modified example of the structure of the insertion guided portion 42 will be described. Here, for the sake of better illustration, the insertion guide portion 35$d$ is seen through.

Parts (a) to (c) of FIG. 8 are side views showing various exemplary structures of the insertion guided portion 42, the abutting portion 42$a$, the restricting portion 42$c$ of the toner cartridge E, respectively.

In this embodiment, as shown in FIG. 7, the insertion guided portion 42 of the toner cartridge E is constituted by a single projection having a long round shape. However, other shapes and structures as shown in parts (a) to (c) of FIG. 8 may be employed as long as they can perform the same function. However, the shape, number, and arrangement of the projections are not limited to the structures shown in the Figures.

That is, as shown in part (a) of FIG. 8, a structure in which a long round projection and a cylindrical projection are combined may be employed. With such a structure, the surface 42$d$ of the elongated round projection comes into contact with the surface 35$d$1 of the insertion guide portion 35$d$, and the surface 42$c$2 of the cylindrical projection contacts the surface 35$d$2 of the insertion guide portion 35$d$. By this, the attitude of the toner cartridge E at the time of insertion is restricted. In addition, the abutting portion 42$a$ of the long round projection abuts against the abutted portion 35$a$, by which the insertion of the toner cartridge E is completed.

In addition, as shown in part (b) of FIG. 8 and part (c) of FIG. 8, the insertion guided portion may be a combination of a plurality of columnar projections. Needless to say, the shape of the projection need not be cylindrical but it may be triangular prism. That is, the shape may be any if the inserted guide portion is arranged along the inserting direction f of the toner cartridge E, and the insertion attitude of the toner cartridge E can be regulated. Similarly, it does not matter whether the number of the insertion guided portion is plural or single.

In the structure of part (b) of FIG. 8, the columnar projections 42$e$ and 42$f$ aligned along the inserting direction f contact the surface 35$d$1 of the insertion guide portion 35$d$. In addition, the surface 42$c$2 of the columnar projection 42 contacts with the surface 35$d$2 of the insertion guide portion 35$d$. By this, the attitude of the toner cartridge E is regulated. Similarly, the columnar projection 42$f$ disposed on the downstream side in the inserting direction f is provided with the abutting portion 42$a$ and the abutting portion 42$a$ abuts against the abutted portion 35$a$. By this, the insertion of the toner cartridge E into the developing unit D is completed.

In addition, in the structure of part (c) of FIG. 8, the columnar projections 42$e$ and 42$f$ aligned along the inserting direction f contact the surface 35$d$1 of the insertion guide portion 35$d$, respectively. In addition, the columnar projections 42$e$ and 42$f$ make contact the surface 35$d$2 of the insertion guide portion 35$d$. By this, the attitude of the toner cartridge E is regulated. In addition, the columnar projection 42$f$ disposed on the downstream side in the inserting direction f is provided with the abutting portion 42$a$, and it abuts against the abutted portion 35$a$, by which the insertion of the toner cartridge E into the developing unit D is completed.

As described above, in the case where a plurality of projections are provided at the longitudinal end portion of the toner cartridge E, it is only necessary to pay attention to the portion in contact with the developing unit D.

Here, in all structures of parts (a) to (c) of FIG. 8, the insertion guided portion 42 and the restricting portion 53$x$1 are projected onto a surface n perpendicular to the inserting direction f. At this time, the projection area 53$y$2 of the restricting portion 53$x$2 falls within in the projection area 50 of the insertion guided portion 42.

(Positioning of Toner Cartridge Relative to Developing Unit)

Referring to part (a) of FIG. 10, part (b) of FIG. 10, part (a) of FIG. 11, part (b) of FIG. 11, positioning of the toner cartridge E relative to the developing unit D will be described.

Part (a) of FIG. 10 is a side view of the insertion guided portion 42 of the toner cartridge E and the frame 35 of the developing unit D in a state that the abutting portion 42$a$ and the abutted portion 35$a$ abut against each other. Part (b) of FIG. 10 is a sectional view of the toner cartridge E and the developing unit D in a state in which the abutting portion 42$a$ and the abutted portion 35$a$ abut against each other.

Part (a) of FIG. 11 is a side view of the insertion guided portion 42 of the toner cartridge E and the frame 35 of the developing unit D in a state in which the toner cartridge E is positioned relative to the developing unit D. Part (b) of FIG. 11 is a sectional view illustrating the engagement relationship between the positioned toner cartridge E and the developing unit D. More specifically, part (b) of FIG. 11 is a cross-sectional view in which the toner cartridge E and the developing unit D are sectioned at the position of the second shutter 53.

Part (a) of FIG. 10 shows a state after the toner cartridge E is inserted into the developing unit D. In order to open and close the first shutter 37 and the second shutter 53, the container 47 is rotated in the direction of the arrow e around the rotation axis S of the toner cartridge E. Then, as shown in part (a) of FIG. 11, the abutting portion 42$a$ and the rotation guided portion 42$b$ are engaged with the rotation guide portion 35$b$. By this, the toner cartridge E is positioned relative to the developing unit D. At this time, the rotation guided portion 42$b$ is guided by the rotation guide portion 35$b$ provided in the developing unit D. By this, the container 47 can rotate smoothly.

[Opening and Closing Operation of Shutter]

In the following, the opening/closing operation of the first shutter 37 provided in the developing unit D and the second shutter 53 provided in the toner cartridge E will be described in detail.

In this embodiment, in the process of mounting the toner cartridge E to the developing unit D, the first shutter 37 of the developing unit D and the second shutter 53 of the toner cartridge E open the second opening portion 30 and the third opening portion 49 (move to the open position), respectively. On the contrary, in the process in which the toner cartridge E is removed from the developing unit D, the first shutter 37 and the second shutter 53 close the second opening portion 30 and the third opening portion 49 (move to the closed position), respectively.

The toner cartridge E is mounted to the developing unit D by a mounting operation involving at least rotational operation. More specifically, the toner cartridge E is linearly inserted into the developing unit D, and thereafter, it is rotated to be mounted to the developing unit D. In interrelation with the rotational motion when mounting the toner cartridge E, the first shutter 37 and the second shutter 53 move from the closed positions to the open positions.

Similarly, the toner cartridge E is dismounted from the developing unit D at least by a dismounting operation including a rotating operation. More specifically, the toner cartridge E is rotated relative to the developing unit D, and thereafter, and is removed from the developing unit D substantially linearly.

Along with the rotating operation at the time of dismounting the toner cartridge E, the first shutter 37 and the second shutter 53 are moved from the open positions to the closed positions.

(Opening Operation of Shutter)

Referring to part (a) of FIG. 1, part (b) of FIG. 10, part (a) of FIG. 11, part (b) of FIG. 11, part (a) of FIG. 12 and part (b) of FIG. 12, the description will be made as to the opening operation of the first shutter 37 of the developing unit D and the second shutter 53 of the toner cartridge E. Part (a) of FIG. 12 is a side view of the insertion guided portion 42 of the toner cartridge E and the frame 35 of the developing unit D with the second opening portion 30 and the third opening portion 49 opened. Part (b) of FIG. 12 is a sectional view of the toner cartridge E and the developing unit D with the second opening portion 30 and the third opening portion 49 opened.

In this embodiment, in a state that the toner cartridge E is positioned relative to the developing unit D (mounted state), the relative positions of the second opening portion 30 and the third opening portion 49 can be different. In other words, the structure is such that at least two positions (two states) can be taken by rotating the toner cartridge E in the state of the toner cartridge E mounted to the developing unit D.

At the first position of the toner cartridge E, the second opening portion 30 and the third opening portion 49 do not overlap each other, and are in non-communicating positions where the first toner containing portion 28 and the second toner container portion 47*t* are in a non-communicated state (part (b) of FIG. 10). In this state, the first shutter 37 is in the closed position closing the second opening portion 30.

At the second position of the toner cartridge E, the second opening portion 30 and the third opening portion 49 overlap each other and are in communication positions where the first toner containing portion 28 and the second toner container portion 47*t* are in the communicating state (part (b) of FIG. 12). In this state, the first shutter 37 is in the open position where the second opening portion 30 is opened.

As shown in part (a) of FIG. 1, when the toner cartridge E is inserted into a predetermined position of the developing unit D, the projection 45 of the container frame 47*a* and the hole portion 37*a* of the first shutter 37 are engaged with each other. That is, the insertion attitude of the toner cartridge E is restricted so that the insertion guided portion 42 is guided by the insertion guide portion 35*d* to insert the projection 45 into the hole portion 37*a*.

In addition, when the toner cartridge E is inserted into the developing unit D, at least a part of the restricting portion 53*x*2 provided at one end in the longitudinal direction of the extending portion 53*x* enters the insertion guide portion 35*d*. In addition, at least a part of the restricting portion 53*x*1 provided at the other longitudinal end of the extending portion 53*x* enters the insertion guide portion 36*d*. That is, by inserting the toner cartridge E into the developing unit D, the restricting portion 53*x*2 and the restricting portion 53*x*1 engage with the insertion guide portion 35*d* and the insertion guide portion 36*d*, respectively.

From the mounting position shown in part (a) of FIG. 1, the container frame 47*a* of the toner cartridge E is rotated in the direction of the arrow e by the operation of the operating portion 44 by the user. By this, the engaged state between the insertion guided portion 42 and the frame 35 becomes the state shown in part (a) of FIG. 11 and then to the state that the second opening portion 30 and the third opening portion 49 shown in part (a) of FIG. 12 overlap with each other (not shown). At this time, the rotational axis S of the toner cartridge E (container frame 47*a*) is substantially parallel to the longitudinal direction of the toner cartridge E.

Here, part (a) of FIG. 1 is a side view when the toner cartridge E is inserted into a predetermined position of the developing unit D as viewed in the longitudinal direction. At this time, the restricting portion 53*x*2 is in a position of contacting with the surface 35*d*2 when the toner cartridge E continues to rotate in the direction of the arrow e around the rotation axis S. For this reason, when the container frame 47*a* starts to rotate in the direction of the arrow e, as shown in part (a) of FIG. 10, the restricting portion 53*x*2 provided at one end in the longitudinal direction of the extending portion 53*x* abuts to the surface 35*d*2 of the insertion guide portion 35*d*. By this, the restricting portion 53*x*2 receives the reaction force F1 from the surface 35*d*2. For this reason, as shown in part (a) of FIG. 11, even if the rotation of the container frame 47*a* in the direction of the arrow e advances, the restricting portion 53*x*2 continues to receive the force F1 from the surface 35*d*2. Therefore, the extending portion 53*x* does not rotate together with the container frame 47*a* in the direction of the arrow e.

In other words, the toner cartridge E is inserted into a predetermined position of the developing unit D. At this time, if the restricting portion 53*x*2 is in a position where it contacts the surface 35*d*2 when the toner cartridge E continues to rotate in the direction of the arrow e around the rotation axis S, the extending portion 53*x* does not rotate together with the container frame 47*a* in the direction of the arrow e.

In addition, part (b) of FIG. 1 is a side sectional view of a state when the toner cartridge E is inserted into a predetermined position of the developing unit D, as seen from the side opposite from the driving side. At this time, the restricting portion 53*x*1 is in a position where it contacts with the surface 36*d*2 when the toner cartridge E continues to rotate in the direction of the arrow e around the rotation axis S. For this reason, when the container frame 47*a* starts to rotate in the direction of the arrow e, as shown in part (b) of FIG. 10, the restricting portion 53*x*1 of the extending portion 53*x* abuts against the surface 36*d*2 of the insertion guide portion 36*d*. By this, the restricting portion 53*x*1 receives the reaction force F2 from the surface 36*d*2. For this reason, as shown in part (b) of FIG. 11, even if the rotation of the container frame 47*a* in the direction of the arrow e advances, the restriction portion 53*x*1 continues to receive the force F2 from the surface 36*d*2. Therefore, the extending portion 53*x* does not rotate together with the container frame 47*a* in the direction of the arrow e.

With the above structure, the insertion guide portions 35*d*, 36*d* restrict the extending portion 53*x* so as not to rotate in the direction of the arrow e together with the container frame 47*a*. This restricts the second shutter 53 from rotating in the arrow e direction together with the container frame 47*a*. From this state, the container frame 47*a* is further rotated in the mounting direction (direction of arrow e) of the toner cartridge E with respect to the developing unit D. Then, the container frame 47*a* moves in the direction (opening direction) to open the third opening portion 49 for supplying the toner to the developing unit.

In other words, the second shutter moves relative to the container frame 47*a* in the direction of opening the third opening portion 49. The force F1 received by the restricting portion 53$x$2 and the force F2 received by the restricting portion 53$x$2 are forces for moving the second shutter 53 from the closed position to the open position.

In addition, as shown in part (b) of FIG. 11, when the container frame 47$a$ rotates in the direction of the arrow e, the surface 45$a$ of the projection 45 and the surface 37$a$1 of the hole portion 37$a$ come into contact with each other and then a force F5 is applied from the surface 45$a$ to the surface 37$a$1. By this, the first shutter 37 is pushed in the rotational direction (the direction of the arrow e) of the container frame 47$a$. As a result, the first shutter 37 moves in interrelation with the rotation of the container frame 47$a$, so that the second opening portion 30 is opened. The projection 45 provided on the container frame 47$a$ is a release force applying portion (open position moving portion, opening/closing member moving portion) for applying the force to the first shutter 37 to move the first shutter 37 to the open position.

Thereafter, as shown in part (a) of FIG. 12 and part (b) of FIG. 12, the first toner containing portion 28 and the second toner containing portion 47 are communicated with each other through the third opening portion 49 and the second opening portion 30. By this, the opening operations of the second opening portion 30 and the third opening portion 49 are completed.

At this time, the abutting portion 42$a$ and the rotation guided portion 42$b$ are engaged with the rotation guide portion 35$b$. By this, with the second opening portion 30 and the third opening portion 49 opened, the relative movement of the toner cartridge E to the developing unit D in the direction of the arrow e is restricted.

In this state, the second drive transmission portion 48 of the toner cartridge E is connected to the drive transmission portion 38 (part (a) of FIG. 4) of the development unit D. By this, the driving force for rotating the second toner feeding member 46 is in a state that it can be transmitted from the developing unit D.

From the above, transportation (supply) of the toner t from the second toner container portion 47$t$ of the toner cartridge E to the first toner containing portion 28 of the developing unit D is enabled.

Here, in this embodiment, the drive transmission portion 38 for transmitting the drive to the second drive transmission portion 48 of the toner cartridge E is provided on the developing unit D side. However, as shown in FIG. 15, a drive transmission portion 38 which is engaged with the second drive transmission portion 48 may be provided on the toner cartridge E side. Here, FIG. 15 is a side view of the toner cartridge E as viewed from the drive side in the case where a drive transmission portion 38 is engaged with the second drive transmission portion 48 is provided. Part (a) of FIG. 15 illustrates a state in which the third opening portion 49 (not shown) is closed by the second shutter 52. In addition, part (b) of FIG. 15 illustrates a state in which the third opening portion 49 (not shown) is opened.

In the modification shown in FIG. 15, the toner cartridge E is provided with two gears (38, 48). The drive transmission portion 38 is a drive input gear for receiving a driving force from the developing unit D. The second drive transmission portion 48 is a transmission gear (second gear) that transmits the driving force received by the drive transmission portion 38 toward the second toner feeding member 46. The second driving force transmitting portion 48 is arranged coaxially with the second toner feeding member 46.

The structure is such that as the second shutter 52 moves from the closed position (part (a) in FIG. 15) to the open position (part (b) in FIG. 15), the restricting portion 53$x$1 and the restricting portion 53$x$2 approach to the axis of the drive input gear (drive transmission portion 38).

Here, the engagement between the gears is called a meshing, and also when a belt or the like provided with the projection engages, it is considered as being meshing.

(Switching From a Toner Cartridge Inserting Operation to the Shutter Release Operation)

Next, referring to parts (a) of FIG. 1, FIG. 9, and part (b) of FIG. 9, switching operation from the inserting operation of the toner cartridge E to the shutter release operation which is a feature of this embodiment will be described. Part (a) of FIG. 9 is a side view illustrating the force relationship acting on the toner cartridge E upon completion of insertion into developing unit D. In addition, part (b) of FIG. 9 is a side view illustrating a force relationship acting on the toner cartridge E in another structure example of the abutting portion 42$a$.

Here, for the sake of convenience, the insertion guide portion 35$d$ is seen through.

As shown in part (a) of FIG. 9, the toner cartridge E is inserted into the developing unit D by the user's operation, by which the abutting portion 42$a$ and the abutted portion 35$a$ abut each other. At this time, the force F1 and the force F2 act on the toner cartridge E. More specifically, the force F1 applied when the toner cartridge E is inserted by the user acts on the operating portion 44, and an equivalent force F2 acts on the abutting portion 42$a$ of the insertion guided portion 42 by a reaction.

Here, a plane (imaginary plane) m parallel to the mounting direction of the toner cartridge E and passing through the rotation axis S of the toner cartridge E (rotation center of the second shutter member 53) is considered. A length of an arm extending from the plane m to the operating portion 44 is r1, and a length of the arm from the rotation axis (rotation center) S to the abutting portion 42$a$ is r2. At this time, a moment M acting around the rotation axis S of the third opening portion 49 (part (d) of FIG. 5) of the toner cartridge E can be expressed by the following equation.

$$M=F1\times r1+F2\times r2$$

In addition, as shown in part (a) of FIG. 9, the direction of rotation of the toner cartridge E (container frame 47$a$) when opening the second opening portion 30 and the third opening portion 49 is the counterclockwise arrow e direction when the toner cartridge E is viewed along the axial direction of rotation of the container frame 47$a$. Here, in this embodiment, the abutting portion 42$a$ is positioned on a plane m passing through the rotation center S of the container frame 47$a$ and parallel to the inserting direction (guide direction) f, and therefore, r2=0. In addition, the operating portion 44 is provided on the downstream side of the plane m in the rotational direction e when the opening direction (the direction of the arrow e) of the second opening portion 30 and the third opening portion 49 is positive.

Therefore, F1×r1>0, and then, M>0.

Because F1×r1>0, M>0, the force F1 which the user applies when inserting the toner cartridge E into the developing unit D is converted into a rotational force in the opening direction e of the second opening portion 30 and the third opening portion 49. Therefore, the entire toner cartridge E is rotated by the force F1 in the direction of inserting the toner cartridge E in the direction f.

Here, the larger the value of the moment M is, the more easily the toner cartridge E is rotated. In other words, the larger the value of the moment M, the easier it is to operate the opening operation of the second opening portion 30 and the third opening portion 49 more smoothly.

Here, as a structure for increasing the moment M, for example, it is conceivable to change the position where the abutting portion 42*a* is disposed as shown in part (b) of FIG. 9. More specifically, it is conceivable to arrange the abutting portion 42*a* at a position away from the operating portion 44 with respect to the plane m passing through the rotation center S of the container frame 47*a* and parallel to the mounting direction f.

When the force acting on the abutting portion 42*a* is F3 and the distance from the surface m to the abutting portion 42*a* is r3 the moment M acting on the center of rotation S can be expressed by the following equation as with the structure in part (a) of FIG. 9.

$$M=F1\times r1+F3\times r3$$

At this time, F3×r3 is the moment of the second opening portion 30 and the third opening portion 49 in the opening direction e. Therefore, the moment M becomes large, and the container frame 47*a* is easy to rotate in the opening direction e. Here, the above-described positional relationship between the abutting portion 42*a* and the operating portion 44 can be applied to the relationship between the abutting portion 43*a* and the operating portion 44, with the result of the same effect.

(Closing Operation of Shutter)

Referring to part (a) of FIG. 10, part (b) of FIG. 10, part (b) of FIG. 11, part (b) of FIG. 12, the closing operation of the first shutter 37 of developing unit D and the second shutter 53 of toner cartridge E will be described. Closing operations of the first shutter 37 and the second shutter 53 are opposite to the opening operation described above. Here, the closing direction of the first shutter 37 and the second shutter 53 is the direction in which the container frame 47*a* rotates in the clockwise direction (the direction of the arrow h in part (b) of FIG. 12) as viewed in the axial direction from the side opposite to the mounting side of the second drive transmission portion 48.

First, in the state shown in part (b) of FIG. 12, the user operates the operating portion 44 to rotate the container frame 47*a* in the closing direction (the direction of arrow h, the closing direction). Then, as shown in part (b) of FIG. 11, the surface 45*b* of the projection 45 of the container frame 47*a* abuts to the surface 37*a*2 of the hole portion 37*a* of the first shutter 37, and a force F6 is applied from the surface 45*b* to the surface 37*a*2. By this, the surface 37*a*2 of the first shutter 37 receives a force in the direction of the arrow h from the surface 45*b* and rotates in interrelation with the rotating operation of the container 47. And, the first shutter 37 moves to the closed position where the first shutter 37 closes the second opening portion 30. The surface 45*b* of the projection 45 is a closing force applying portion for moving the first shutter 37 to the closed position by applying a force to the first shutter 37.

In addition, in the state of FIG. 12, the user operates the operating portion 44 to rotate the container frame 47*a* in the closing direction (the direction of arrow h, the closing direction).

Here, the restricting portion 53*x*2 is in a position where it contacts the surface 35*d*1 (part (a) of FIG. 12), when the toner cartridge E continues to rotate in the direction of the arrow h around the rotation axis S. Similarly, the restricting portion 53*x*1 is in a position where it contacts the surface 35*d*1, when the toner cartridge E continues to rotate in the direction of the arrow h around the rotation axis S.

When the container frame 47*a* starts to rotate in the direction of the arrow h, the restricting portion 53*x*2 of the extending portion 53*x* abuts against the surface 35*d*1 of the insertion guide portion 35*d*, as shown in part (a) of FIG. 11. By this, the restricting portion 53*x*1 receives the reaction force F3 from the surface 35*d*1. For this reason, as shown in part (a) of FIG. 10, even if the rotation of the container frame 47*a* in the direction of the arrow h advances, the restriction portion 53*x*2 continues to receive the reaction force F3 from the surface 35*d*1. Therefore, the extending portion 53*x* does not rotate together with the container frame 47*a* in the direction of the arrow h.

Similarly, when the container frame 47*a* starts to rotate in the direction of the arrow h, the restricting portion 53*x*1 of the extended portion 53*x* abuts against the surface 36*d*1 of the insertion guide portion 36*d*, as shown in part (b) of FIG. 11. By this, the restricting portion 53*x*1 receives the force F4 in a direction of an arrow Y from the surface 36*d*1. For this reason, as shown in part (b) of FIG. 10, even if the rotation of the container frame 47*a* in the direction of the arrow h advances, the restriction portion 53*x*1 continues to receive the reaction force F4 from the surface 36*d*2. Therefore, the extending portion 53*x* does not rotate together with the container frame 47*a* in the direction of the arrow h.

From the foregoing, the insertion guide portions 35*d*, 36*d* regulate the rotation of the extension portion 53*x* with the container frame 47*a* in the direction of the arrow h. That is, they regulate the rotation of the second shutter 53 with the container frame 47*a* in the direction of the arrow h.

The second shutter 53 and the container frame 47*a* become movable relative to each other. Therefore, the second shutter 53 moves relative to the container frame 47*a* to the closed position for closing the third opening portion 49.

The force F3 received by the restricting portion 53*x*2 and the force F4 received by the restricting portion 53*x*1 are effective to move the second shutter 53 from the open position to the closed position.

And, when the container frame 47*a* is further rotated in the closing direction (direction of arrow h), the toner cartridge E is ready to be removed from the developing unit D, as shown in part (a) of FIG. 10 and part (b) of FIG. 10. At this time, the second opening portion 30 and the third opening portion 49 are closed by the first shutter 37 and the second shutter 53, respectively.

In a state where the toner cartridge E has been inserted in the mounting position of the developing unit D (part (a) of FIG. 9), the operating portion 44 is positioned on the downstream (in the rotational direction of the container frame 47*a*) side of an imaginary plane m passing through the rotation center and extending in the inserting direction f, as viewed in the direction of the axis of rotation of the container frame 47*a*. The structure is such that in this position, the operating portion 44 receives a force to rotate the container frame 47*a* by the user's operation. This position is a position where a moment acting to rotate the container frame 47*a* with respect to the developing unit D is produced when the operating portion 44 receives a force acting in the inserting direction f.

In other words, in the toner cartridge E according to this embodiment, the structure is such that the force (arrow R in FIG. 9) acting on the operating portion 44 when rotating the container frame 47*a* at this position includes a component force (arrow Rf in FIG. 9) in the inserting direction f. By the user applying the force to the operating portion 44 in the inserting direction f at the time of insertion, the force in the inserting direction f acts on the operating portion 44, when the toner cartridge E reaches the mounting position. That is, when the toner cartridge E reaches the mounting position, a part of the force required to rotate the container frame 47*a* has already been applied to the operating portion 44. Therefore, by the user's operation of pushing the operating portion 44 in the inserting direction f, the force in the inserting direction f continues to act on the operating portion 44 even when the container frame 47*a* rotates following insertion of the toner cartridge E into the mounting position.

By this, the user grips the operating portion (gripping portion) 44 and inserts the toner cartridge E to the mounting position of the developing unit D, and thereafter, the force conversion from the inserting operation to the rotating operation is executed smoothly, in a series of mounting operations for rotating the container frame 47*a*. Therefore, the user can intuitively operate the insertion of the toner cartridge E into the developing unit D and the opening operation of the first shutter 37 and the second shutter 53, thereby significantly improving operability.

In addition, in this embodiment, when the toner cartridge E is at the mounting position, as the toner cartridge E is viewed in the direction of the axis of rotation of the container frame 47*a*, the operating portion (gripping portion) 44 is disposed at a position more remote from the center of rotation (rotation axis) than the abutting portion 42*a*. The structure is such that in this state, the operating portion 44 receives a force from the user. By this, the container frame 47*a* can be rotated with a small force against the sliding resistance between the abutting portion 42*a* and the abutted portion 35*a* and the rotation guide portion 35*b* during the rotation of the container frame 47*a*. The same applies to the sliding resistance between the abutment portion 43*a* and the abutted portion 36*a* and the rotation guide 36*b*.

The arrangement of the operating portion 44 in this embodiment will be described in more detail referring to FIG. 19. FIG. 19 is an illustration for explaining the arrangement of the operation portion, and shows a state in which the toner cartridge E is viewed along the longitudinal direction of the toner cartridge E.

FIG. 19 shows a state in which the second shutter 53 closes the third opening portion 49. In this state, the operating portion 44 is arranged between a leading end 53*c* of the second shutter 53 and the extending portion 53*x*. More specifically, in the direction of the arrow u, the operating portion 44 is located on the upstream side of the leading end (the end on the downstream side in the arrow b direction) 53*c* of the second shutter 53. And, the operating portion 44 is disposed on the downstream side of the extending portion 53*x* and the restricting portions (engaging portions) 53*x*1, 53*x*2 in the direction of the arrow u. When the operating portion 44 is provided at such a position, the extension portion 53*x* and the restriction portions 53*x*1, 53*x*2 do not hinder movement of the operation portion when the user opens the second shutter 53 by operating the operating portion 44. That is, when the second shutter 53 is opened, the operating portion 44 is moved in the direction of the arrow u, and therefore, the extending portion 53*x* (restricting portions 53*x*1, 53*x*2) disposed on the upstream side of the operating portion 44 in the direction of the arrow u is less likely to affect the movement of the operating portion 44.

Here, the arrow u direction is the direction in which the container 47 and the operating portion 44 move relative to the second shutter 53 when the second shutter 53 opens the toner outlet (third opening portion 49). At this time, the second shutter 53 moves relative to the container 47 and the operating portion 44 in the direction of the arrow n opposite to the arrow u. The direction of the arrow n is the moving direction of the second shutter 53 (the opening direction of the opening and closing member) when the discharge opening is released.

Here, the direction of the arrow n indicates the direction in which the container 47 and the operating portion 44 move relative to the second shutter 53 (the moving direction of the container 47) when the second shutter 53 closes the discharge opening (the third opening portion 49). At this time, the second shutter 53 moves in the direction of the arrow u relative to the container 47 and the operating portion 44. That is, the direction of the arrow u is also the moving direction of the shutter 53 (the closing direction of the opening and closing member) when the discharge opening is closed.

That is, in the closing direction (the direction of the arrow u) in which the second shutter 53 moves relative to the container 47 so as to close the third opening portion 49, the operating portion 44 is located upstream of the downstream end of the second shutter 53, and is located on the downstream side of the extending portion 53*x* (restricting portions 53*x*1, 53*x*2).

Here, with the center R of the container 47 as a reference, the restricting portion (53*x*1, 53*x*2) and the operating portion 44 occupy the region of the angle θ1. In this embodiment, the angle θ1 is 50 degrees or less. That is, with the center of the container 47 as a reference, the whole of the restricting portion (53*x*1, 53*x*2) and the whole of the operating portion 44 are in the region within an angle of 50 degrees. It is preferable that at least a part of the restricting portion (53*x*1, 53*x*2) and a part of the operating portion 44 are in the region of the angle of 50 degrees. As described above, the toner cartridge E can be kept small in size.

Here, the center R of the container 47 as the reference of the angle θ1 is the rotation axis of the container 47. That is, when opening and closing the second shutter 53, the center R of rotation of the container 47 is the reference of the angle θ1. In addition, the frame of the container 47 has a substantially cylindrical shape. The center R of this cylindrical shape is the reference of the angle θ1. (modification example of regulation portion)

Here, as shown in FIG. 10, in this embodiment, the restricting portion 53*x*1 and the restricting portion 53*x*2 provided in the extending portion 53*x* are constituted to have a circular cross-sectional shape as viewed from the longitudinal direction. However, as long as the above-described arrangement condition is satisfied, the cross-sectional shape thereof is not limited to a circular shape.

A modified example of the structure of the restricting portion 53*x*2 will be described referring to part (a) of FIG. 16, part (b) of FIG. 16, and part (c) of FIG. 16. Part (a) of FIG. 16, part (b) of FIG. 16, and part (c) of FIG. 16 are the views as seen from a side opposite (in the longitudinal direction) the driving side, when the toner cartridge E is inserted into a predetermined position of the developing unit D. However, it is not intended to limit the shape, number and arrangement of projections to the illustrated example. In addition, the shape and the like are not limited to the restricting portion 53*x*2 but may be employed for the restricting portion 53*x*1.

That is, in the part (a) of FIG. 16, the cross-sectional shape of the restricting portion 53*x*2 as viewed in the longitudinal direction may be square. Each of the insertion guided portion 42 and the restricting portion 53*x*2 is projected on the line n perpendicular to the inserting direction f. At this time, even with this structure, the projection area 53*y*2 of the restriction portion 53*x*2 falls in the projection area 50 of the insertion guided portion 42.

In addition, the restricting portion 53*x*2 is in a position where it contacts the surface 35*d*2 when the toner cartridge E continues to rotate around the rotation axis S in the direction of the arrow e. More specifically, a surface 53$x$2$a$ of the restricting portion 53$x$2 on the downstream side in the direction of the arrow e is in a position where it contacts the surface 35$d$2 when the toner cartridge E continues to rotate in the direction of the arrow e around the rotation axis S. For this reason, when the toner cartridge E continues to rotate in the direction of the arrow e, the surface 53$x$2$a$ continues to receive the force F1 from the surface 35$d$2. Therefore, the extended portion 53$x$ does not rotate in the direction of the arrow e together with the container frame 47$a$ (not shown). In addition, the restricting portion 53$x$2 is in a position where it contacts the surface 35$d$1 when the toner cartridge E continues to rotate around the rotation axis S in the direction of the arrow h. More specifically, the surface 53$x$2 $b$ of the restricting portion 53$x$2 on the downstream side in the direction of the arrow h is in a position where it contacts the surface 35$d$1 when the toner cartridge E continues to rotate in the direction of the arrow h around the rotation axis S. For this reason, when the toner cartridge E continues to rotate in the direction of the arrow h, the surface 53$x$2 $b$ continues to receive the force F3 from the surface 35$d$2. Therefore, the extended portion 53$x$ does not rotate in the direction of arrow h together with the container frame 47$a$ (not shown).

In addition, as shown in part (b) of FIG. 16, the cross-sectional shape at the end of the extended portion 53$x$ may not be a circle or a square. Here, in this embodiment, the restricting portion 53$x$2 is a portion indicated by a surface 53$x$2 $c$, a surface 53$x$2 $d$, and a surface 53$x$2 $e$. At this time, as each of the insertion guided portion 42 and the restricting portion 53$x$2 is projected onto the line n perpendicular to the inserting direction f, the projection area 53$y$2 of the restricting portion 53$x$2 falls in the projection area 50 of the insertion guided portion 42.

In addition, when the toner cartridge E is inserted into a predetermined position of the developing unit D, a part of the restricting portion 53$x$2 enters the insertion guide 35$d$. At this time, the surface 53$x$2 $c$ of the restricting portion 53$x$2 is in a position where it contacts the surface 35$d$2 when the toner cartridge E continues to rotate around the rotation axis S in the direction of the arrow e. More specifically, the surface 53$x$2$c$ on the downstream side in the direction of the arrow e of the restricting portion 53$x$2 is in a position where it contacts the surface 35$d$2 when the toner cartridge E continues to rotate in the direction of the arrow e around the rotation axis S. For this reason, when the toner cartridge E continues to rotate in the direction of the arrow e, the surface 53$x$2$c$ continues to receive the force F1 from the surface 35$d$2. Therefore, the extended portion 53$x$ does not rotate in the direction of the arrow e together with the container frame 47$a$ (not shown).

In addition, the restricting portion 53$x$2 is in a position where it contacts the surface 35$d$1 when the toner cartridge E continues to rotate around the rotation axis S in the direction of the arrow h. More specifically, the surface 53$x$2$d$ of the restricting portion 53$x$2 on the downstream side in the direction of the arrow h is in a position where it contacts the surface 35$d$1 when the toner cartridge E continues to rotate in the direction of the arrow h around the rotation axis S. For this reason, when the toner cartridge E continues to rotate in the direction of the arrow h, the surface 53$x$2 $d$ continues to receive the force F3 from the surface 35$d$2. Therefore, the extended portion 53$x$ does not rotate in the direction of arrow h together with the container frame 47$a$ (not shown).

In addition, as shown in part (c) of FIG. 16, the restricting portion 53$x$2 may be provided by a plurality of members. Here, in this embodiment, the restricting portion 53$x$2 is the portions indicated by the projection 53$x$2 $f$ and the projection 53$x$2 $g$. When projecting each of the insertion guided portion 42 and the restricting portion 53$x$2 onto a line n perpendicular to the inserting direction f, the projection area 53$y$2 of the restricting portion 53$x$2 falls in the projection area 50 of the insertion guided portion 42.

In addition, when the toner cartridge E is inserted into a predetermined position of the developing unit D, a part of the restricting portion 53$x$2 enters the insertion guide 35$d$. At this time, the projection 53$x$2 $f$ of the restricting portion 53$x$2 is in a position where contacts the surface 35$d$2 when the toner cartridge E continues to rotate around the rotation axis S in the direction of the arrow e. For this reason, when the toner cartridge E continues to rotate in the direction of the arrow e, the projection 53$x$2$f$ continues to receive the force F1 from the surface 35$d$2. Therefore, the extended portion 53$x$ does not rotate in the direction of the arrow e together with the container frame 47$a$ (not shown).

In addition, the projection 53$x$2 $g$ of the restricting portion 53$x$2 is in a position where contacts the surface 35$d$1 when the toner cartridge E continues to rotate around the rotation axis S in the direction of the arrow h. For this reason, when the toner cartridge E continues to rotate in the direction of the arrow h, the projection 53$x$2 $g$ continues to receive the force F3 from the surface 35$d$2. Therefore, the extended portion 53$x$ does not rotate in the direction of arrow h together with the container frame 47$a$ (not shown).

(Modified Example of Developing Unit D)

Next, a modified example of the developing unit D will be described referring to FIGS. 17 and 18. FIG. 17 is a perspective view illustrating the periphery of the first shutter 37 of the developing unit D, in which part (a) shows a state in which the first shutter 37 is opened, and part (b) shows a closed state. FIG. 18 is a sectional view of the toner cartridge E and the developing unit D. Part (a) of FIG. 18 shows a process in which the toner cartridge E is inserted into the developing unit D, and part (b) of FIG. 18 shows a state in which the insertion of the toner cartridge E is completed. In addition, part (c) of FIG. 18 is an enlarged view of a part of part (b) of FIG. 18.

In this modified example, a lock arm (receiving apparatus side locking member) 61 is provided in the developing unit D in order to prevent unintended opening of the first shutter 37. As shown in FIG. 17, two lock arms 61 are provided on the developing unit D, and each of the lock arms 61 has a claw portion (engaging portion, projecting portion, locking portion) 61$a$ at the free end thereof. In addition, the lock arm 61 can be elastically deformed.

The claw portion 61$a$ of the lock arm 61 is located at the same position as the hole portion 37$a$ of the first shutter 37 in the longitudinal direction of the developing unit D.

And, in the state in which the first shutter 37 closes the second opening portion 30, the claw portion 61$a$ enters the hole portion 37$a$ to engage with the hole portion 37$a$. By this, the claw portion 61$a$ locks the movement of the first shutter 37 and suppresses unintended opening of the first shutter 37.

Here, in the course of inserting the toner cartridge E into the developing unit D, as shown in part (b) of FIG. 18, the two projections 45 provided on the toner cartridge E come into contact with the corresponding claw portions 61$a$. When the projection 45 comes into contact with the claw portion 61$a$, the lock arm 61 elastically deforms so that the claw portion 61$a$ is retracted from the hole portion 37$a$ to unlock the first shutter 37. That is, the first shutter 37 becomes movable.

When the toner cartridge E is rotated relative to the developing unit D in the state shown in part (b) of FIG. 18, as described above, the claw portion 45 is engaged with the hole portion 37*a*, so that the first shutter 37 can move to the open position.

In addition, when the toner cartridge E is dismounted from the developing unit D, the claw portion 61*a* enters the hole portion 37*a* to lock the first shutter 37 in interrelation with the operation of retracting the projection 45 from the hole portion 37*a* (Part (a) of FIG. 18).

In the modified example described above, the projection 45 of the toner cartridge E serves as a release projection for releasing the locking of the lock arm 61.

(Summary)

In this embodiment, the second shutter 53 is constituted to be rotatable around the container 47 (container frame 47*a*). By this, the second shutter 53 can be opened and closed by an operation (rotating operation) in which the toner cartridge E rotates relative to the developing unit D (receiving device). When opening and closing the second shutter 53 by the rotating operation of the toner cartridge E the space required for opening and closing the second shutter 53 (Space) can be reduced, as compared with the case of opening and closing the second shutter 53 by the linear movement of the toner cartridge E.

That is, when the toner cartridge E rotates relative to the developing unit D, the center of the toner cartridge E (the rotation axis S) hardly moves relative to the developing unit D although the attitude of the toner cartridge E changes. That is, in the opening and closing operation of the second shutter 53, the area occupied by the toner cartridge E in the developing unit D hardly changes. As a result, it is unnecessary to provide a large space for the developing unit D in order to open and close the second shutter 53. That is, by employing the toner cartridge E as in this embodiment, it is possible to downsize the receiving apparatus (developing unit D) which receives the toner cartridge E and the image forming apparatus provided with the receiving apparatus.

INDUSTRIAL APPLICABILITY

According to the present invention, a toner cartridge for forming an electrophotographic image and a toner supply mechanism are provided.

SYMBOLS

16: photosensitive drum (image bearing member)
17: charging roller
19: cleaning blade
24: developing roller (developer carrying member)
25: developing blade
27: first toner feeding means
28: first toner containing portion (developer accommodating portion)
29: first opening
30: second opening (containing body opening, receiving opening)
31: developing chamber
32: first seal
34: first shutter guide portion
35: frame
35*a*: abutted portion
35*d*: insertion guide portion
36*a*: abutted portion
36*d*: insertion guide portion
37: first shutter
37*a*: hole portion
38: first drive transmission portion (second gear)
42: insertion guided portion (guided portion, toner cartridge side guide portion)
42*a*: abutting portion
43: insertion guided portion (guided portion, toner cartridge side guide portion)
43*a*: abutting portion
44: operating portion
45: projection (container side engaging portion, opening/closing member moving portion, container side projection)
46: second toner feeding member
47: container
47*a*: container frame
47*a*1: side wall
47*a*2: side wall
47*t*: second toner container
48: second drive transmission portion
49: third opening (container opening, discharge opening)
53: second shutter
53*c*: free end portion
53*m*: shutter body
53*x*: extension
53*x*1: restriction surface
53*x*2: restriction surface
54: second seal
58: communication portion
A: image forming apparatus
C: drum unit
D: developing unit
E: toner cartridge
f: inserting direction
t: toner

The invention claimed is:

1. A toner cartridge comprising:

(1) a container including (1-1) an accommodating portion for accommodating toner, (1-2) a discharge opening for discharging the toner from the accommodating portion, and (1-3) at least one projection projecting outwardly of the container more than a side wall of the container in a longitudinal direction of the container and extending along a predetermined direction; and (2) an open/close member including (2-1) a closing portion for closing the discharge opening, (2-2) an engaging portion projecting outwardly of the container more than a side wall of the container in the longitudinal direction of the container, wherein the open/close member being is movable relative to the container between a closed position for causing the closing portion to close the discharge opening and an open position for causing the closing portion to open opening the discharge opening, and wherein when the projection and the engaging portion are projected onto a first imaginary line that is perpendicular to the predetermined direction as the toner cartridge is seen in the longitudinal direction, at least a part of a projection area of the engaging portion is between a projection area of the projection.

2. A toner cartridge according to claim 1, wherein the container is provided with an operating portion.

3. A toner cartridge according to claim 2, wherein when the open/close member is in the closed position, the operating portion is positioned upstream of a downstream end portion of the closing portion and downstream of the engaging portion in a closing direction in which the open/close member moves to close the discharge opening.

4. A toner cartridge according to claim 2, wherein, as seen in the longitudinal direction in a state that the open/close member closes the discharge opening, at least a part of the engaging portion and at least a part of the operating portion are disposed at an angle range of not more than 50° about a center of the container.

5. A toner cartridge according to claim 2, wherein the operating portion has a U-shape.

6. A toner cartridge according to claim 1, wherein the open/close member includes two engaging portions, and wherein the engaging portions are provided at opposite longitudinal end portions of the open/close member, respectively.

7. A toner cartridge according to claim 1, wherein the open/close member is provided with an extending portion extending over an entire area of the container in a longitudinal direction of the container, and wherein the engaging portion is provided at an end portion of the extending portion.

8. A toner cartridge according to claim 7, wherein the open/close member is provided with at least two such engaging portions, and wherein the engaging portions are provided at opposite end portions of the extending portion, respectively.

9. A toner cartridge according to claim 7, wherein at least a part of the extending portion is made of metal.

10. A toner cartridge according to claim 1, wherein the container includes a second projection and a third projection which are arranged in the longitudinal direction of the container and which are projected in a radial direction of the container, and wherein by a operation of the open/close member closing the discharge opening, a downstream end portion of the closing portion in a closing direction of open/close member approaches the second projection and the third projection.

11. A toner cartridge according to claim 10, wherein as the second and third projections and the discharge opening are projected onto a second imaginary line extending in the longitudinal direction of the container, at least a part of a projection area of the discharge opening is between projection areas of the second and third projections.

12. A toner cartridge according to claim 10, wherein on the second imaginary line, an entirety of the projection area of the discharge opening is between projection areas of the second and third projections.

13. A toner cartridge according to claim 1, wherein the container is provided with a drive input gear for receiving a driving force from outside of the toner cartridge.

14. A toner cartridge according to claim 13, wherein the container is provided with a feeding member configured to feed the toner from the accommodating portion toward the discharge opening by the driving force received by the drive input gear.

15. A toner cartridge according to claim 14, wherein the container is provided with a second gear engaging with the drive input gear to receive the driving force.

16. A toner cartridge according to claim 15, wherein the second gear is provided coaxial wither the feeding member.

17. A toner cartridge according to claim 13, wherein with movement of the open/close member from the closed position toward the open position, the engaging portion approaches an axis of the drive input gear.

18. A toner cartridge according to claim 1, wherein the container has a substantially cylindrical shape.

19. A toner cartridge according to claim 1, wherein the open/close member is rotatable around and along the container.

20. A toner cartridge according to claim 1, wherein the container guides the open/close member by covering an end portion of the closing portion.

* * * * *